US010095169B2

(12) United States Patent
Takagi

(10) Patent No.: US 10,095,169 B2
(45) Date of Patent: Oct. 9, 2018

(54) DEVELOPING CARTRIDGE

(71) Applicant: Brother Kogyo Kabushiki Kaisha, Nagoya-shi, Aichi-ken (JP)

(72) Inventor: Takeyuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/484,452

(22) Filed: Apr. 11, 2017

(65) Prior Publication Data

US 2017/0219974 A1 Aug. 3, 2017

Related U.S. Application Data

(63) Continuation of application No. 15/243,121, filed on Aug. 22, 2016, now Pat. No. 9,651,895, which is a (Continued)

(30) Foreign Application Priority Data

Mar. 24, 2010 (JP) ..... 2010-068576

(51) Int. Cl.
*G03G 15/00* (2006.01)
*G03G 15/08* (2006.01)
(Continued)

(52) U.S. Cl.
CPC ..... *G03G 15/50* (2013.01); *G03G 15/0865* (2013.01); *G03G 15/0889* (2013.01); *G03G 15/0896* (2013.01); *G03G 21/1676* (2013.01); *G03G 21/1896* (2013.01); *G03G 2221/1892* (2013.01)

(58) Field of Classification Search
CPC ..... G03G 15/0089; G03G 15/0865; G03G 15/0896; G03G 21/1676; G03G 21/1896; G03G 2221/1892
See application file for complete search history.

(56) References Cited

U.S. PATENT DOCUMENTS 7,953,330 B2 5/2011 Ishikawa
8,417,130 B2 4/2013 Hashimoto
(Continued)

FOREIGN PATENT DOCUMENTS

CN 101256379 A 9/2008
EP 1696282 A2 8/2006
(Continued)

OTHER PUBLICATIONS

European Patent Office, extended European Search Report for European Patent Application No. 11002318.1 (counterpart to above captioned patent application), dated Jun. 30, 2011.
(Continued)

*Primary Examiner* — Ryan Walsh
(74) *Attorney, Agent, or Firm* — Banner & Witcoff, Ltd.

(57) ABSTRACT

A developing cartridge may include a rotary gear rotatable about one axis and a detection gear rotatable about another axis. The detection gear is configured to be not rotatable with the rotary gear in a case where the rotary gear rotates from a first rotational position to a second rotational position, while being configured to be rotatable with the rotary gear in a case where the rotary gear rotates from the second rotational position to a third rotational position.

5 Claims, 37 Drawing Sheets

Related U.S. Application Data continuation of application No. 14/694,495, filed on Apr. 23, 2015, now Pat. No. 9,448,505, which is a continuation of application No. 14/229,106, filed on Mar. 28, 2014, now Pat. No. 9,042,777, which is a continuation of application No. 13/053,020, filed on Mar. 21, 2011, now Pat. No. 8,712,286.

(51) Int. Cl.
*G03G 21/18* (2006.01)
*G03G 21/16* (2006.01)

(56) References Cited

U.S. PATENT DOCUMENTS

| | | | |
|---|---|---|---|
| 8,676,064 | B2 | 3/2014 | Takagi |
| 9,042,777 | B2 | 5/2015 | Takagi |
| 9,104,172 | B2 | 8/2015 | Takagi |
| 9,746,801 | B2 | 8/2017 | Jang et al. |
| 2005/0031359 | A1 | 2/2005 | Ishii |
| 2006/0193643 | A1 | 8/2006 | Takagi et al. |
| 2006/0193645 | A1 | 8/2006 | Kishi |
| 2006/0193646 | A1 | 8/2006 | Suzuki et al. |
| 2008/0205911 | A1 | 8/2008 | Ishikawa et al. |
| 2008/0205931 | A1 | 8/2008 | Ishikawa |
| 2008/0223173 | A1 | 9/2008 | Ishikawa |
| 2009/0000423 | A1 | 1/2009 | Ishikawa et al. |
| 2009/0269086 | A1 | 10/2009 | Mikuni |
| 2011/0211864 | A1 | 9/2011 | Ishikawa |
| 2011/0211866 | A1 | 9/2011 | Hashimoto |
| 2011/0236062 | A1 | 9/2011 | Takagi |
| 2011/0236065 | A1 | 9/2011 | Takagi |
| 2011/0236066 | A1 | 9/2011 | Takagi |
| 2011/0280627 | A1 | 11/2011 | Matsuda |
| 2012/0243882 | A1 | 9/2012 | Carot |

FOREIGN PATENT DOCUMENTS

| | | | |
|---|---|---|---|
| EP | 1696283 | A1 | 8/2006 |
| EP | 1696284 | A2 | 8/2006 |
| EP | 1950625 | A2 | 7/2008 |
| EP | 1965274 | A2 | 9/2008 |
| JP | 05-204195 | A | 8/1993 |
| JP | H06-115732 | A | 4/1994 |
| JP | 2005-055544 | A | 3/2005 |
| JP | 2006-163304 | A | 6/2006 |
| JP | 2006-243072 | A | 9/2006 |
| JP | 2006-267994 | A | 10/2006 |
| JP | 2008-216394 | A | 9/2008 |
| JP | 2009-244562 | A | 10/2009 |
| JP | 2009-265401 | A | 11/2009 |

OTHER PUBLICATIONS

European Patent Office, extended European Search Report for European Patent Application No. 11002316.5 (counterpart to above-captioned patent application), dated Jun. 30, 2011.
European Patent Office, extended European Search Report for European Patent Application No. 11002317.3 (counterpart to above-captioned patent application), dated Jun. 30, 2011.
International Searching Authority, International Search Report for International Patent Application No. PCT/JP2011/0057129 (counterpart International patent application), dated Mar. 24, 2011.
The State Intellectual Property Office of the People's Republic of China, Notification of the First Office Action for Chinese Patent Application No. 201110077194.1 (counterpart Chinese patent application), dated Aug. 9, 2012.
The State Intellectual Property Office of the People's Republic of China, Notification of the First Office Action for Chinese Patent Application No. 201110077268.1 (counterpart Chinese patent application), dated Aug. 13, 2012.
The State Intellectual Property Office of the People's Republic of China, Notification of the First Office Action for Chinese Patent Application No. 201110075937.1 (counterpart Chinese patent application), dated Aug. 2, 2012.
International Searching Authority, International Search Report for International Patent Application No. PCT/JP2011/057127 (counterpart International patent application), dated Apr. 26, 2011.
International Searching Authority, International Search Report for International Patent Application No. PCT/JP2011/057128 (counterpart International patent application), dated Apr. 26, 2011.
Japan Patent Office, Notification of Reasons for Refusal for Japanese Patent Application No. 2010-068573 (related to above-captioned patent application), dated Nov. 19, 2013.
Japan Patent Office, Notification of Reasons for Refusal for Japanese Patent Application No. 2010-068572 (related to above-captioned patent application), dated Nov. 19, 2013.
Japan Patent Office, International Search Report for International Patent Application No. PCT/JP2011/057127 (counterpart to co-pending U.S. Appl. No. 13/053,074), dated Apr. 26, 2011.
Japan Patent Office, International Search Report for International Patent Application No. PCT/JP2011/057128 (counterpart to co-pending U.S. Appl. No. 13/053,374), dated Apr. 26, 2011.
Japan Patent Office, International Search Report for International Patent Application No. PCT/JP2011/057129 (counterpart to co-pending U.S. Appl. No. 13/053,374), dated Apr. 26, 2011.
Apr. 2, 2015—U.S. Notice of Allowance—U.S. Appl. No. 14/189,305.
Dec. 17, 2014—U.S. Non-Final Office Action—U.S. Appl. No. 14/189,305.
Nov. 5, 2015—U.S. Non-Final Office Action—U.S. Appl. No. 14/790,388.
Jul. 17, 2014—U.S. Final Office Action—U.S. Appl. No. 14/045,902.
Dec. 18, 2014—U.S. Ex Parte Quayle—U.S. Appl. No. 14/045,902.
May 11, 2015—U.S. Final Office Action—U.S. Appl. No. 14/045,902.
Sep. 29, 2015—U.S. Notice of Allowance—U.S. Appl. No. 14/045,902.
Mar. 11, 2016—U.S. Notice of Allowance—U.S. Appl. No. 14/790,388.
May 10, 2016—U.S. Non-Final Office Action—U.S. Appl. No. 14/988,380.
Jul. 25, 2016—U.S. Non-Final Office Action—U.S. Appl. No. 15/186,970.
Oct. 19, 2016—U.S. Final Office Action—U.S. Appl. No. 14/988,380.
Nov. 21, 2016—U.S. Final Office Action—U.S. Appl. No. 15/186,970.
Mar. 15, 2017—U.S. Notice of Allowance—U.S. Appl. No. 15/186,970.
Mar. 28, 2017—U.S. Non-final Office Action—U.S. Appl. No. 14/988,380.
Aug. 3, 2017—U.S. Notice of Allowance—U.S. Appl. No. 14/988,380.
Mar. 27, 2018—(US) Ex Parte Quayle—U.S. Appl. No. 15/799,232.
Mar. 21, 2018—(CN) Notification of First Office Action—App 201410562527.3.
Aug. 9, 2018—U.S. Non-final Office Action—U.S. Appl. No. 15/799,232.

DEVELOPING CARTRIDGE

CROSS-REFERENCE TO RELATED APPLICATION

This application is a continuation of U.S. patent application Ser. No. 15/243,121 filed Aug. 22, 2016, which is a continuation of U.S. patent application Ser. No. 14/694,495 filed Apr. 23, 2015, issued as U.S. Pat. No. 9,448,505 on Sep. 20, 2016, which is a continuation of U.S. patent application Ser. No. 14/229,106 filed Mar. 28, 2014, issued as U.S. Pat. No. 9,042,777 on May 26, 2015, which is a continuation of U.S. patent application Ser. No. 13/053,020 filed Mar. 21, 2011, issued as U.S. Pat. No. 8,712,286 on Apr. 29, 2014, which claims priority from Japanese Patent Application No. 2010-068576, filed on Mar. 24, 2010, the entire subject matter of which are incorporated herein by reference.

TECHNICAL FIELD

Aspects of the present invention relate to a developing cartridge which is detachably mounted in an apparatus main body of an image forming apparatus such as a laser printer.

BACKGROUND

In an image forming apparatus such as a laser printer, a developing cartridge is detachably mounted in an apparatus main body. Toner is accommodated within the developing cartridge. When toner in the developing cartridge is used up, the developing cartridge is removed from the apparatus main body. Then, a new developing cartridge is mounted in the apparatus main body. In addition, when a sheet is jammed in the apparatus main body, there may be a situation in which the developing cartridge is removed from the apparatus main body, and after the jam is resolved, the developing cartridge is remounted in the apparatus main body.

In this type of image forming apparatuses, there is proposed an image forming apparatus in which a detection gear having an abutment projection is provided on a side surface of a developing cartridge, and when the developing cartridge is mounted in an apparatus main body, information on the developing cartridge is obtained based on rotation of the detection gear.

The detection gear is provided to be rotatable about an axis which extends in a direction which orthogonally intersects the side surface of the developing cartridge. Gear teeth are formed on a circumferential surface of the detection gear except a part thereof. Namely, the detection gear is a partly non-tooth gear. In addition, a transmission gear is provided on the side surface of the developing cartridge to be rotatable about an axis which extends in parallel to the axis of the detection gear with a space therebetween. The transmission gear rotates integrally with an agitator for agitating toner accommodated in the developing cartridge. Gear teeth are formed on a circumferential surface of the transmission gear so as to extend along the full circumference thereof. With a new developing cartridge, the gear teeth of the detection gear mesh with the gear teeth of the detection gear. When the developing cartridge is mounted in the apparatus main body, a driving force of a motor is inputted into the transmission gear, and the driving force is transmitted from the detection gear to the detection gear via the gear teeth of these gears.

With the driving force so transmitted, the detection gear rotates, and the abutment projection moves as the detection gear rotates. A sensor is provided in the apparatus main body for detecting a passage of the abutment projection while the abutment projection is regarded as a detection target. Then, whether the developing cartridge is new or used is determined based on whether or not the passage of the abutment projection is detected by the sensor within a predetermined length of time after the start of driving of the motor. When the detection gear continues to rotate so that a non-tooth portion of the detection gear comes to oppose the gear teeth of the transmission gear, the mesh engagement of the gear teeth of the transmission gear with the gear teeth of the detection gear is released, whereby the detection gear stops rotating (for example, see JP-A-2006-267994).

SUMMARY

Accordingly, an aspect of the present invention is to provide a developing cartridge which is superior to the conventional one in the configuration including a detectable member such as an abutment projection.

According to an illustrative embodiment of the present invention, there is provided a developing cartridge which is detachably mounted in an apparatus main body of an image forming apparatus, the developing cartridge comprising: a housing including a first side wall and a second side wall which are provided to oppose each other, the housing configured to accommodate developer therein; a receiving member provided on an outer side of the first side wall to be rotatable about a first axis which extends in an opposing direction of the first side wall and the second side wall, the receiving member configured to couple with a driving force output member provided in the apparatus main body to receive a driving force from the driving force output member; a developing roller provided between the first side wall and the second side wall to be rotatable about a second axis which extends in parallel to the first axis with a space therebetween, the developing roller configured to rotate by the driving force received by the receiving member; a first rotary member provided on the outer side of the first side wall to be rotatable about a third axis which extends in parallel to the first axis with a space therebetween, the first rotary member configured to rotate by the driving force received by the receiving member; a second rotary member provided on the outer side of the first side wall to be rotatable about a fourth axis which extends in parallel to the third axis with a space therebetween, the second rotary member configured to take a driven position where the second rotary member rotates by the driving force transmitted from the first rotary member and a non-driven position where the transmission of the driving force from the first rotary member is cut off; a detectable member provided on the outer side of the first side wall and configured to move in association with the rotation of the second rotary member and function as a detection target to be detected by a detection member provided in the apparatus main body; and a first engagement portion provided on the outer side of the first side wall in a position separated from a fifth axis which extends in parallel to the first axis with a space therebetween, the first engagement portion configured to rotate about the fifth axis by the driving force received by the receiving member, wherein the second rotary member includes a second engagement portion which is provided in a position separated from the fourth axis, wherein when the second rotary member is in the non-driven position, the second engagement portion is provided on a rotating locus drawn by the first engagement portion, and wherein the first engagement portion is configured to engage with the second engagement portion as the first engagement portion rotates, so that the second engagement portion moves rotationally about the fourth axis by a force received from the first engagement portion, whereby the second rotary member rotates from the non-driven position to the driven position.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, an illustrative embodiment of the present invention will be described in detail by reference to the accompanying drawings.

1. OVERALL CONFIGURATION OF LASER PRINTER

Figure 1:
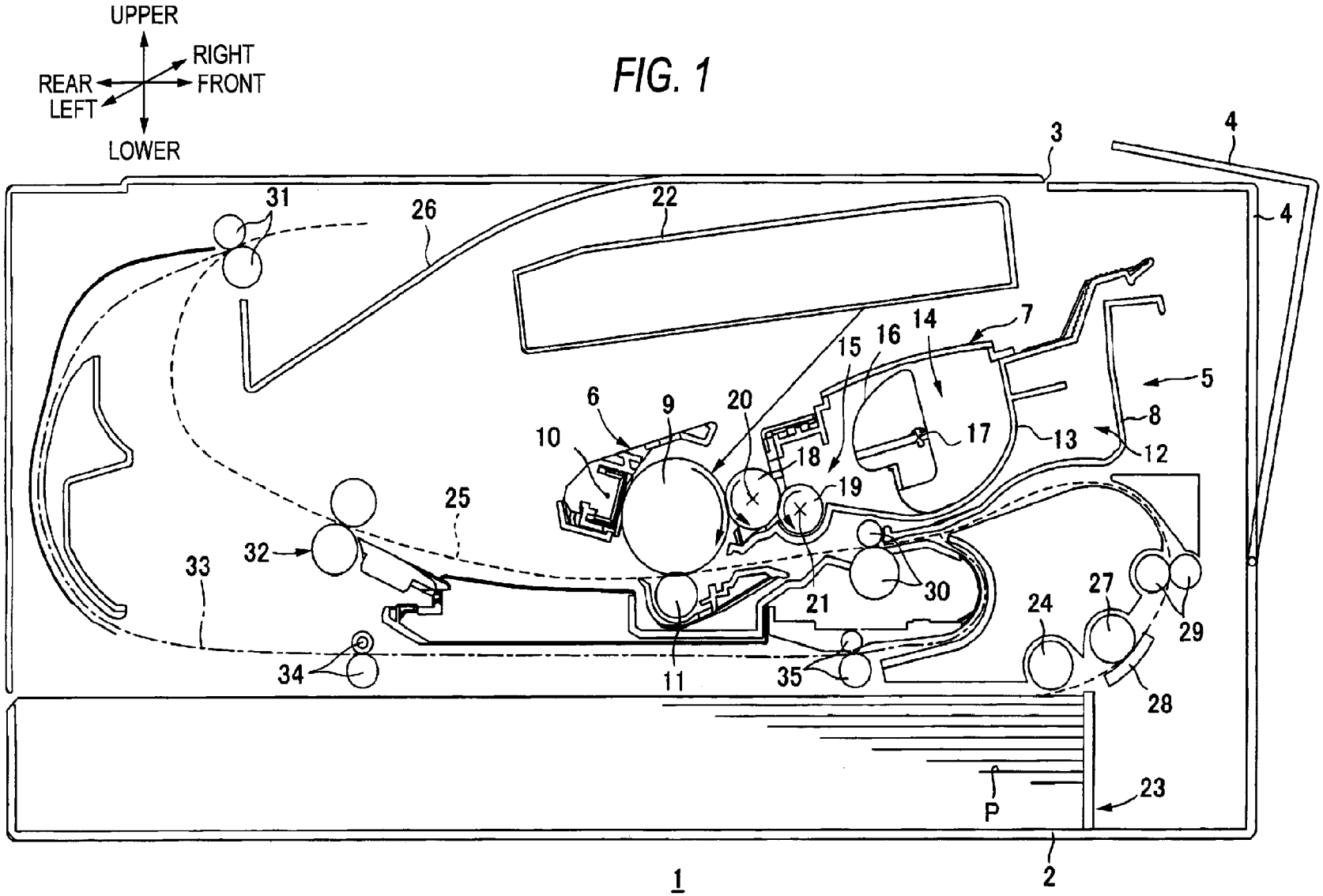
FIG. 1 is a sectional view of a laser printer in which a developing cartridge according to an illustrative embodiment of the present invention is mounted.

As shown in FIG. 1, a laser printer 1 (an example of an image forming apparatus) includes a body casing 2 (an example of an apparatus main body). A cartridge mount/removal opening 3 is formed in one side wall of the body casing 2, and a front cover 4 is provided for opening and closing the cartridge mount/removal opening 3.

Note that in the following description, the side of the laser printer 1 where the front cover 4 is provided is referred to as a front side thereof. Upper, lower, left and right sides of the laser printer are so determined based a situation in which the laser printer 1 is viewed from the front side thereof In addition, a front and rear of a developing cartridge 7 is so determined based on a situation in which the developing cartridge 7 is mounted in the body casing 2, and upper, lower, left and right sides thereof are so determined based on a situation in which the developing cartridge 7 is viewed from the front side thereof.

A process cartridge 5 is mounted in the body casing 2 in a position which is situated slightly further forwards than a center thereof. With the front cover 4 opened, the process cartridge 5 is mounted in and removed from the body casing 2 via the cartridge mount/removal opening 3.

The process cartridge 5 includes a drum cartridge 6 and a developing cartridge 7 which is detachably attached in the drum cartridge 7.

The drum cartridge 6 includes a drum frame 8. A photosensitive drum 9 is held rotatably at a rear end portion of the drum frame 8. In addition, a charger 10 and a transfer roller 11 are held in the drum frame 8. The charger 10 and the transfer roller 11 are provided at the rear of and below the photosensitive drum 9.

A portion of the drum frame 8 situated further forwards than the photosensitive drum 9 is configured as a developing cartridge attachment portion 12, and the developing cartridge 7 is mounted in this developing cartridge attachment portion 12.

The developing cartridge 7 includes a housing 13 which accommodates toner therein. A toner accommodation compartment 14 and a developing compartment 15, which communicate with each other, are formed in an interior of the housing 13 so as to be situated adjacent to each other in a front-rear direction.

An agitator 16 is provided in the toner accommodation compartment 14 to be rotatable about an agitator rotating axis 17 which extends in a left-right direction. Toner accommodated in the toner accommodation compartment 14 is supplied from the toner accommodation compartment 14 to the developing compartment 15 while being agitated by rotation of the agitator 16.

A developing roller 18 and a supply roller 19 are provided in the developing compartment 15 to be rotatable about a developing rotating axis 20 and a supplying rotating axis 21, respectively, which extend in the left-right direction. The developing roller 18 is provided so that a part of a circumferential surface thereof is exposed from a rear end portion of the housing 13. The developing cartridge 7 is attached in the drum cartridge 6 so that the circumferential surface of the developing roller 18 is brought into contact with a circumferential surface of the photosensitive drum 9. The supply roller 19 is provided so that a circumferential surface thereof is brought into contact with the circumferential surface of the developing roller 18 from the front and below the developing roller 18. Toner in the developing compartment 15 is supplied to the circumferential surface of the developing roller 18 by the supply roller 19 and is carried on the circumferential surface of the developing roller 18 in the form of a thin layer.

An exposing unit 22 which emits a laser beam is provided above the process cartridge 5 in the body casing 2.

When forming an image, the photosensitive drum 9 is rotated clockwise as viewed in FIG. 1 at a constant speed. The circumferential surface (the surface) of the photosensitive drum 9 is charged uniformly by discharge from the charger 10. On the other hand, a laser beam is emitted from the exposing unit 22 based on image data received from a personal computer (not shown) which is connected to the printer 1. The laser beam passes between the charger 10 and the developing cartridge 7 and is shone on to the circumferential surface of the photosensitive drum 9 which is uniformly positively charged so as to expose the circumferential surface of the photosensitive drum 9 selectively. By this exposure, electric charges are selectively removed from the portion of the photosensitive drum 9 which is so exposed, whereby an electrostatic latent image is formed on the circumferential surface of the photosensitive drum 9. When the latent image comes to confront the developing roller 18 as a result of rotation of the photosensitive drum 9, toner is supplied to the latent image from the developing roller 18, whereby a toner image is formed on the circumferential surface of the photosensitive drum 9.

A sheet feeding cassette 23 is provided at a bottom portion of the body casing 2. A pickup roller 24 is provided above the sheet feeding cassette 23 for feeding sheets out of the sheet feeding cassette 23.

In addition, a conveying path 25, which has an S-shape as viewed from a side thereof, is formed in the body casing 2. This conveying path 25 extends from the sheet feeding cassette 23 to reach a sheet discharging tray 26 which is formed on an upper surface of the body casing 2 by way of a nip between the photosensitive drum 9 and the transfer roller 11. Provided on the conveying path 25 are a separation roller 27 and a separation pad 28, which are provided so as to oppose each other, a pair of sheet feeding rollers 29, a pair of registration rollers 30 and a pair sheet discharging rollers 31.

Sheets P which are fed out of the sheet feeding cassette 23 are fed in between the separation roller 27 and the separation pad 28 so as pass therebetween sheet by sheet. Thereafter, the sheet P is conveyed towards the registration rollers by the sheet feeding rollers 29. Then, the sheet P is registered by the registration rollers 30 and is thereafter conveyed towards between the photosensitive drum 9 and the transfer roller 11 by the registration rollers 30.

When the toner image comes to face the sheet P passing between the photosensitive drum 9 and the transfer roller 11 as a result of rotation of the photosensitive drum 9, the toner image on the circumferential surface of the photosensitive drum 9 is electrically attracted by the transfer roller 11 so as to be transferred to the sheet P.

A fixing unit 32 is provided on the conveying path 25 in a position situated further downstream in the conveying direction of the sheet P than the transfer roller 11.

The sheet P to which the toner image is transferred is conveyed along the conveying path 25 and passes the fixing unit 32. In the fixing unit 32, the toner image is transformed into an image which is fixed on the sheet P by virtue of heat and pressure.

This printer 1 has, as operation modes, a single-side printing mode in which an image (a toner image) is formed on one side of a sheet P and a double-side printing mode in which after an image is formed on one side a sheet P, an image is formed on the other side of the sheet P which is opposite to the one side where the image has already been formed.

In the single-side printing mode, the sheet P on one side of which the image is formed is discharged into the sheet discharging tray 26 by the sheet discharging rollers 31.

A reversely conveying path 33 is formed in the body casing 2 so as to realize the double-side printing mode. The reversely conveying path 33 starts from a position in proximity to the sheet discharging rollers 31, extends between the conveying path 25 and the sheet feeding cassette 23 and is finally connected to a portion on the conveying path 25 which is situated between the sheet feeding rollers 29 and the registration rollers 30. Provided on the reversely conveying path 33 are a pair of first reversely conveying rollers 34 and a pair of second reversely conveying rollers 35.

In the double-side printing mode, after an image is formed on one side of a sheet P, the sheet P is not discharged into the sheet discharging tray 26 but is fed into the reversely conveying path 33. Then, the sheet P is conveyed along the reversely conveying path 33 by the first reversely conveying rollers 34 and the second reversely conveying rollers 35 and is turned inside out so as to be fed into the conveying path 25 in a posture in which the other side of the sheet P on which no image is formed faces the circumferential surface of the photosensitive drum 9. Then, an image is formed on the other side of the sheet P, whereby the formation of the images on both the sides of the sheet P is performed.

2. DEVELOPING CARTRIDGE (1) Housing

Figure 2A:
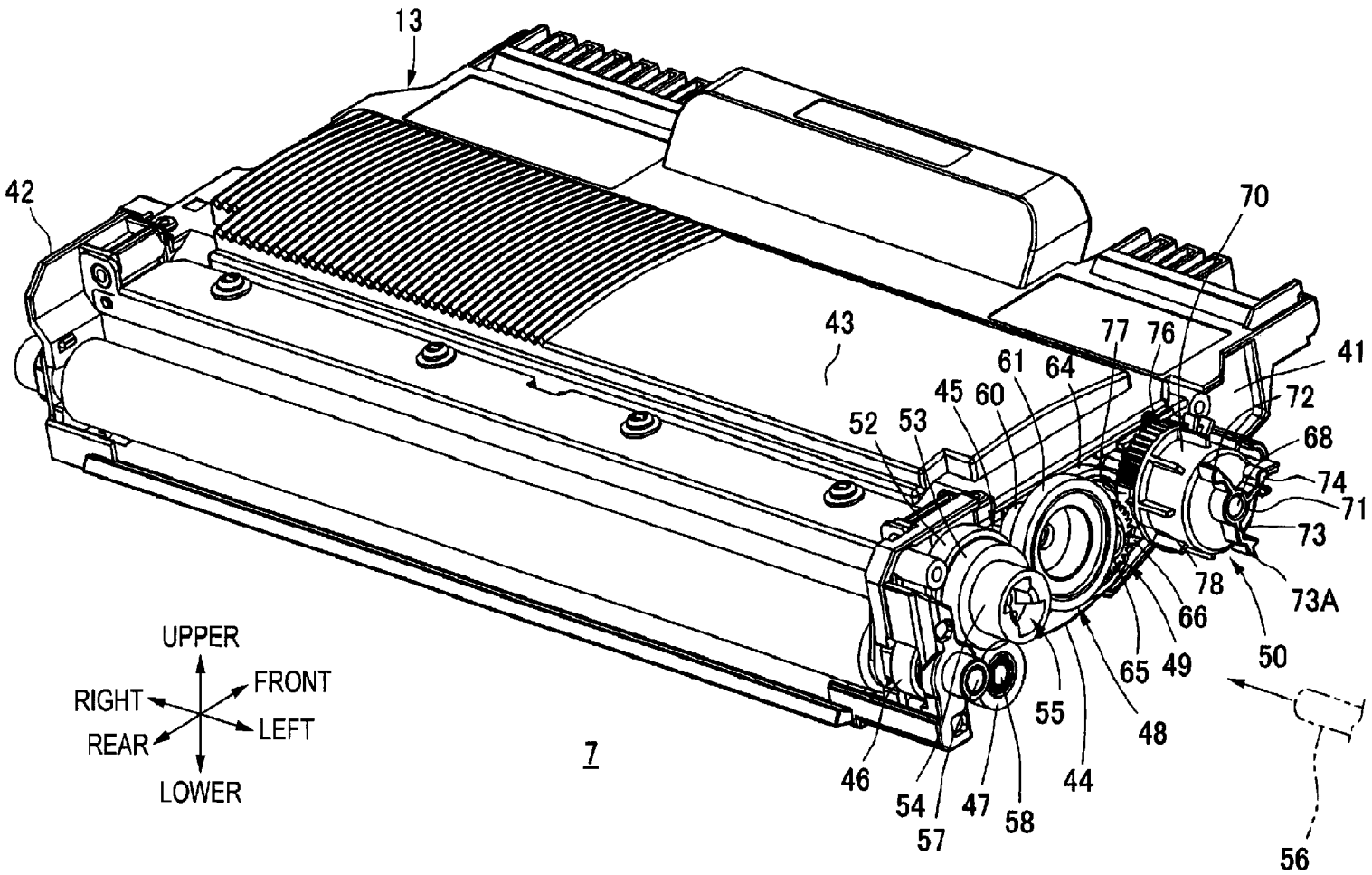
FIG. 2A is a perspective view of the developing cartridge as viewed from the left rear thereof.

As shown in FIG. 2A, the housing 13 of the developing cartridge 7 has a box shape which is opened at a rear side. Specifically, the housing 13 has a first side wall 41 and a second side wall 42. The first side wall 41 and a second side wall 42 oppose each other in the left-right direction. The first and second side walls 41, 42 each have a plate-like shape and extend in the front-rear direction. In addition, the housing 13 has an upper wall 43 and a lower wall 44 which extend between upper end portions and lower end portions of the first side wall 41 and the second side wall 42, respectively. A front end portion of the lower wall 44 extends upwards while being curved and is connected to a front end portion of the upper wall 43.

(2) Gears

Figure 2B:
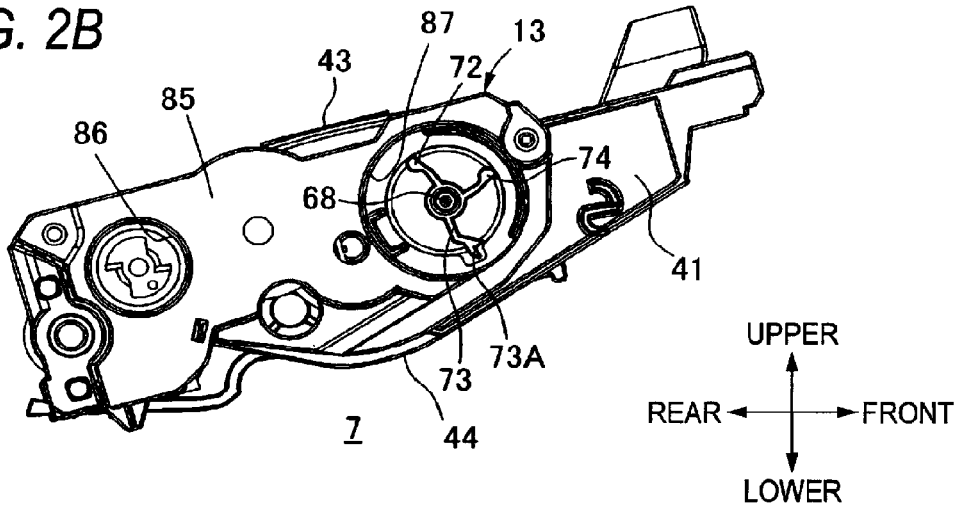
FIG. 2B is a left side view of the developing cartridge shown in FIG. 2A with a gear cover attached.
Figure 2C:
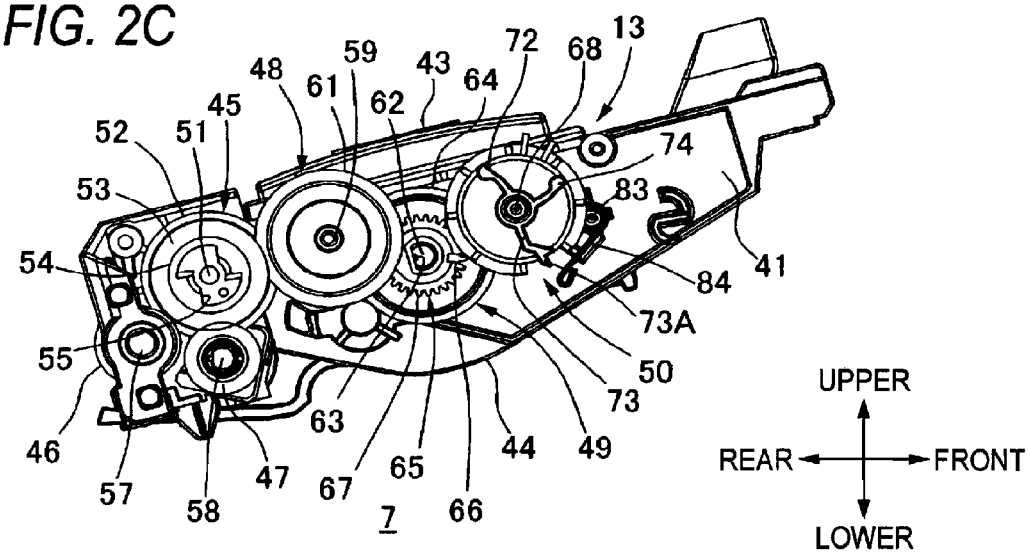
FIG. 2C is a left side view of the developing cartridge shown in FIG. 2A.

As shown in FIGS. 2A, 2C, an input gear 45 (an example of a receiving member), a developing gear 46, a supply gear 47, an intermediate gear 48, an agitator gear 49 (an example of a first rotary gear), and a detectable rotary member 50 (an example of a second rotary gear) are provided on an outer side (a left-hand side) of the first side wall 41 which is situated at a left-hand side of the housing 13.

(2-1) Input Gear

The input gear 45 is provided at an upper portion of a rear end of the first side wall 41. The input gear 45 is provided to be rotatable about an input gear rotation shaft 51 which extends in the left-right direction. The input gear rotation shaft 51 is held in the first side wall 41 so as not to rotate.

The input gear 45 has integrally a large-diameter gear portion 52, a small-diameter gear portion 53 and a coupling portion 54. The large-diameter gear portion 52, the small-diameter gear portion 53 and the coupling portion 54 are aligned in that order from the first side wall 41 side.

The large-diameter gear portion 52 has a disc shape whose axis coincides with the input gear rotation shaft 51. Gear teeth (for example, inclined gear teeth) are formed on a circumferential surface of the large-diameter gear portion 52 along the full circumference thereof.

The small-diameter gear portion 53 has a disc shape whose axis coincides with the input gear rotation shaft 51 and is formed smaller in diameter than the large-diameter gear portion 52. Gear teeth (for example, inclined gear teeth) are formed on a circumferential surface of the small-diameter gear portion 53 along the full circumference thereof.

The coupling portion 54 has a disc shape whose axis coincides with the input gear rotation shaft 51 and has a circumferential surface which is smaller in diameter than the circumferential surface of the small-diameter gear portion 53. A coupling recess portion 55 is formed in a left-hand side surface of the coupling portion 54. A distal end portion of a driving force output member 56 (refer to FIG. 2A) which is provided in the body casing 2 is inserted into the coupling recess portion 55 in such a state that the developing cartridge 7 is mounted in the body casing 2.

The driving force output member 56 is provided so as to advance and retreat in the left-right direction. With the developing cartridge 7 mounted in the body casing 2, the driving force output member 56 advances rightwards along an axis of the input gear rotational shaft 51, so that the distal end portion thereof is inserted into the coupling recess portion 55, whereby the driving force output member 56 and the coupling recess portion 55 are coupled together so as not to rotate relatively. Therefore, when the driving force output member 56 is rotated by a driving force from a motor (not shown) in the body casing 2, a rotation force of the driving force output member 56 is received by the input gear 45, whereby the input gear 45 rotates together with the driving force output member 56. Specifically, the coupling recess portion 55 has a receiving surface which contacts the driving force output member 56 to receive the rotation force of the driving force output member 56.

(2-2) Developing Gear

The developing gear 46 is provided at the rear of and below the input gear 45. The developing gear 46 is attached to a developing roller shaft 57 that the developing roller 18 possesses so as not to rotate relatively. The developing roller shaft 57 is rotatably provided in the first side wall 41, and an axis of the developing roller shaft 57 constitutes a developing rotation axis 20 (refer to FIG. 1) (an example of a second axis) which is a rotation axis of the developing roller 18. Gear teeth are formed on a circumferential surface of the developing gear 46 along the full circumference thereof, and the gear teeth mesh with the gear teeth of the large-diameter gear portion 52 of the input gear 45.

(2-3) Supply Gear

The supply gear 47 is provided below the input gear 45. The developing gear 47 is attached to a supply roller shaft 58 that the supply roller 19 (refer to FIG. 1) possesses so as not to rotate relatively. The supply roller shaft 58 is rotatably provided in the first side wall 41, and an axis of the supply roller shaft 58 constitutes a supplying rotation axis 20 (refer to FIG. 1) which is a rotation axis of the supply roller 19. Gear teeth are formed on a circumferential surface of the supply gear 47 along the full circumference thereof, and the gear teeth mesh with the gear teeth of the small-diameter gear portion 53 of the input gear 45.

(2-4) Intermediate Gear

The intermediate gear 48 is provided in front of the input gear 45. The intermediate gear 48 is provided to be rotatable about an intermediate gear rotation shaft 59 which extends in the left-right direction. The intermediate gear rotation shaft 59 is held in the first side wall 41 so as not to rotate.

The intermediate gear 48 integrally has a small-diameter portion 60 having a disc shape with a relatively small outside diameter and a large-diameter portion 61 having a cylindrical shape with a relatively large outside diameter. The small-diameter portion 60 and the large-diameter portion 61 are aligned in that order from the first side wall 41 side. Axes of the small-diameter portion 60 and the large-diameter portion 61 coincide with an axis of the intermediate gear rotation shaft 59.

Gear teeth are formed on a circumferential surface of the small-diameter portion 60 along the full circumference thereof.

Gear teeth are formed on an circumferential surface of the large-diameter portion 61 along the full circumference thereof. The gear teeth of the large-diameter portion 61 mesh with the gear teeth of the small-diameter gear portion 53 of the input gear 45.

(2-5) Agitator Gear

The agitator gear 49 is provided at the front of and below the intermediate gear 48. As shown in FIG. 2C, the agitator gear 49 is attached to an agitator rotation shaft 62 so as not to rotate relatively. Specifically, the agitator rotation shaft 62 penetrates the first side wall 41 in the left-right direction. In the housing 13, the agitator 16 is attached to the agitator rotation shaft 62. A part of a circumferential surface of a left end portion of the agitator rotation shaft 62 is cut out so that the left end portion of the agitator rotation shaft 62 has a D-shape as viewed from a side thereof. Then, on the outer side of the first side wall 41, the left end portion of the agitator shaft rotation shaft 62 is inserted through a shaft insertion hole 63 having a D-shape as viewed from a side thereof which is formed so as to penetrate the agitator gear 49 in the left-right direction, whereby the agitator gear 49 is attached to the agitator rotation shaft 62 so as not to rotate relatively.

The agitator rotation shaft 62 is held rotatably in the first side wall 41 and the second side wall 42 (refer to FIG. 2A). By being so held, the agitator 16 and the agitator gear 49 can rotate together with the agitator rotation shaft 62 about an axis of the agitator rotation shaft 62 which is an agitator rotation axis 17 (refer to FIG. 1).

The agitator gear 49 integrally has a large-diameter gear portion 64, a small-diameter gear portion 65 and an engagement portion 66.

The large-diameter gear portion 64 has a disc shape whose axis coincides with the agitator rotation shaft 62. Gear teeth are formed on a circumferential surface of the large-diameter gear portion 64 along the full circumference thereof. The gear teeth of the large-diameter gear portion 64 mesh with the gear teeth of the small-diameter portion of the intermediate gear 48.

The small-diameter gear portion 65 is formed on a side of the large-diameter gear portion 64 which is opposite to a side thereof which opposes the first side wall 41, has a disc shape whose axis coincides with the agitator rotation shaft 62 and is formed smaller in diameter than the large-diameter gear portion 64. Gear teeth 67 (an example of first gear teeth) are formed on a circumferential surface of the small-diameter gear portion 65 along the full circumference thereof.

The engagement portion 66 is provided on a left end face of the small-diameter gear portion 65. The engagement portion 66 has its height in the left-right direction and has a substantially triangular shape as viewed from a side thereof which extends in a radial direction of the small-diameter gear portion 65. An end portion of the engagement portion 66 which is opposite to an end portion which opposes the agitator rotation shaft 62 has the same shape, when viewed from a side thereof, as one of the gear teeth 67 of the small-diameter gear portion 65 and is completely superimposed on one gear teeth 67 in the left-right direction.

(2-6) Detectable Rotary Member

The detectable rotary member 50 is provided in front of the agitator gear 49. As shown in FIGS. 2A to 2D, the detectable rotary member 50 is provided to be rotatable about a rotation shaft 68 which extends in the left-right direction. The rotation shaft 68 is held in the first side wall 41 so as not to rotate.

The detectable rotary member 50 integrally has a partly non-tooth gear portion 69, a raised portion 70, a cylindrical portion 71, a first detectable portion 72 (an example of a detectable member), a second detectable portion 73 and a third detectable portion 74.

Figure 2D:
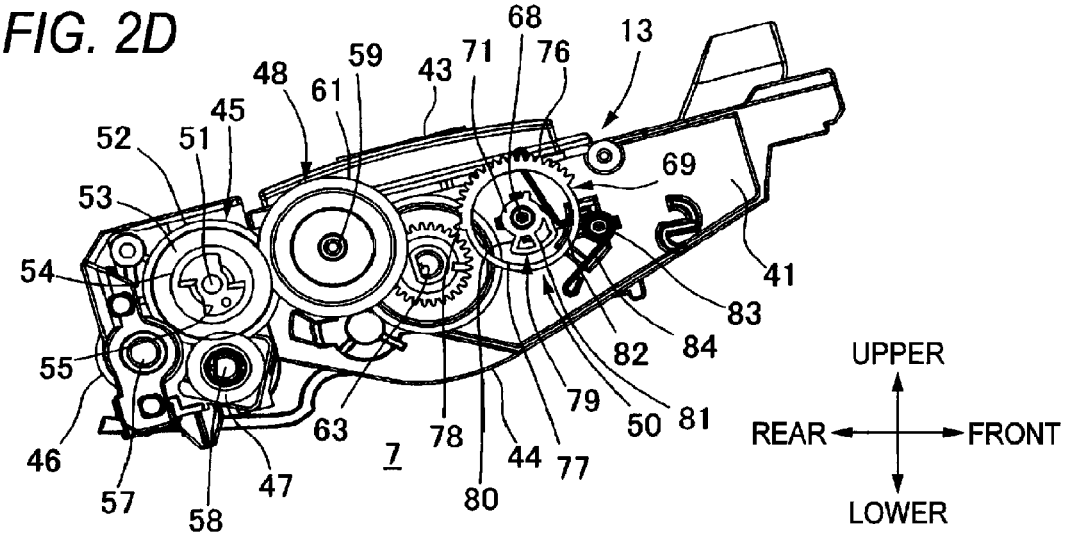
FIG. 2D is a left side of the developing cartridge shown in FIG. 2A with a part of a detectable rotary member detached.

As shown in FIG. 2D, the partly non-tooth gear portion 69 has a double-cylinder shape whose axis coincides with the rotation shaft 68.

Gear teeth 76 (an example of second gear teeth) are formed on a part of a circumferential surface of an outer cylindrical portion, that is, on an outermost circumferential surface of the partly non-tooth gear portion 69. Specifically, a portion of the outermost circumferential surface of the partly non-tooth gear portion 69 whose central angle is about 230.degree. is configured as a non-tooth portion 77 (an example of a cut-off mechanism), and the gear teeth 76 are formed on the other portion than the non-tooth portion 77 of the outermost circumferential surface whose central angle is about 130.degree. The gear teeth 76 have a gear width which is larger than that of the gear teeth 67 of the small-diameter gear portion 65 of the agitator gear 49, and right end faces of the gear teeth 76 are provided on the same plane as right end faces of the gear teeth 67. By adopting this configuration, left end portions of the gear teeth 76 do not mesh with the gear teeth 67 irrespective of the rotational position of the detectable rotary member 50, and portions of the gear teeth 76 other than the left end portions mesh with the gear teeth 67 depending on the rotational position of the detectable rotary member 50.

Figure 2E:
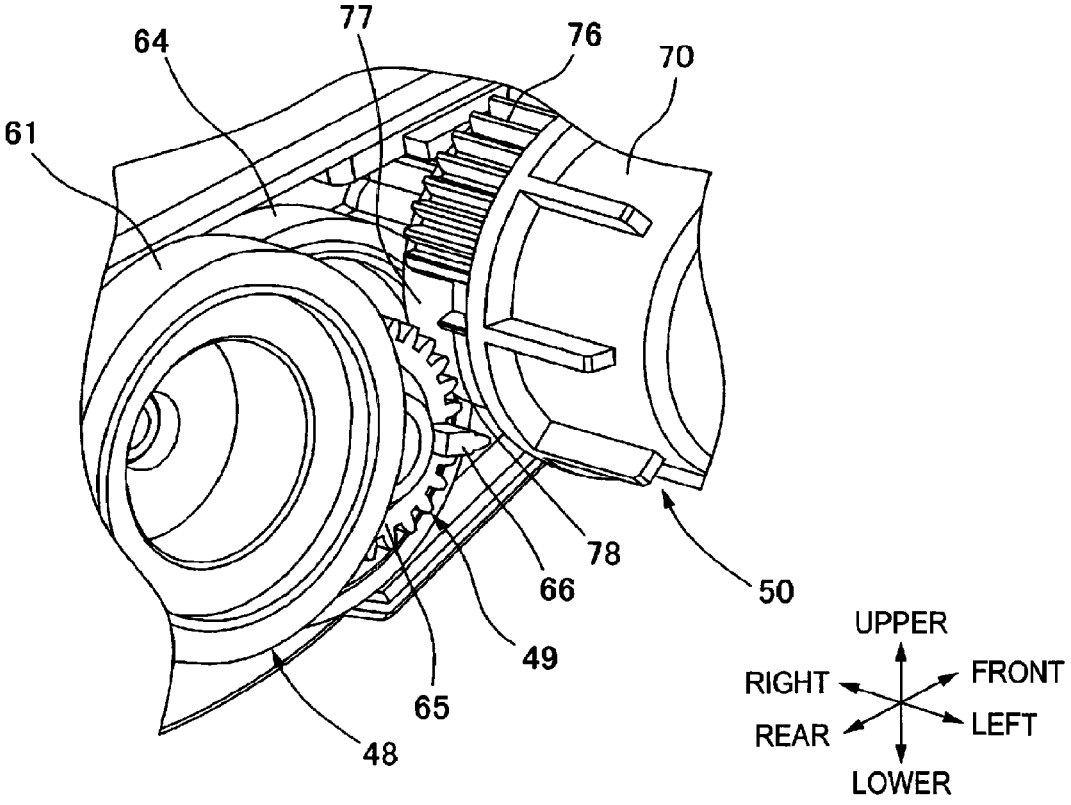
FIG. 2E is a perspective view of a part of the developing cartridge shown in FIG. 2A in an enlarged manner.

An engagement portion 78 is formed at an upstream side end portion in the rotating direction of the detectable rotary member 50 (counterclockwise in FIG. 2D) of the non-tooth portion 77. As shown in FIG. 2E, the engagement portion 78 has a triangular shape as viewed from a side thereof and extends in a radial direction of the detectable rotary member 50 a length which is substantially the same as a height of the gear teeth 76. The engagement portion 78 opposes a left end portion of the gear tooth 76 which is provided at a most downstream end in the rotating direction of the train of gear teeth 76 with a space defined therebetween in the rotating direction. Here, the engagement portion 78 does not oppose a right end portion of the gear tooth 76 in the rotating direction which is provided at the most downstream end in the rotating direction of the train of gear teeth 76 (specifically, a portion of the gear tooth 76 which is situated further rightwards than the left end portion (described above) which does not mesh with the gear teeth 67). By this configuration, the engagement portion 78 is not brought into abutment with the gear teeth 67 of the small-diameter gear portion 65 of the agitator gear 49 irrespective of the rotational position of the detectable rotary member 50. A rotational locus drawn by the engagement portion 78 when the detectable rotary member 50 rotates partly overlaps a rotational locus drawn by the engagement portion 66 when the agitator gear 49 rotates.

A pressed portion 79 is formed integrally on an inner cylindrical portion of the partly non-tooth gear portion 69. The pressed portion 79 has a first radially extending portion 80 which extends radially from a circumferential surface of the inner cylindrical portion, a rotating direction extending portion 81 which extends in the rotating direction of the detectable rotary member 50 from a distal end portion of the first radially extending portion 80 towards a downstream side in the rotating direction and a second radially extending portion 82 which extends from a distal end portion of the rotating direction extending portion 81 towards the circumferential surface of the cylindrical portion. The first radially extending portion 80 extends in a direction which substantially orthogonally intersects a line which connects the gear tooth 76 of the gear teeth 76 which is provided at the most downstream side and the rotation shaft 68 (in detail, a direction which forms an angle of about 85.degree. with respect to the line). In addition, the rotating direction extending portion 81 is formed to extend along an arc which is centered at an axis of the rotation shaft 68 and whose central angle is about 80.degree. and opposes the non-tooth portion 77.

The raised portion 70 has a cylindrical shape whose axis coincides with the rotation shaft 68. A through hole (not shown) is formed in the raised portion 70 along its axis, and the rotation shaft 68 is inserted through the through hole.

The cylindrical portion 71 has a cylindrical shape and projects from a left end face of the raised portion 70. A left end portion of the rotation shaft 68 is inserted into the cylindrical portion 71.

The first detectable portion 72 extends from the cylindrical portion 71 in a radial direction of the raised portion 70 on a left end face of the raised portion 70. In the rotating direction of the detectable rotary member 50, a distal end portion of the first detectable portion 72 is provided substantially in the same position as a central portion of the train of gear teeth 76 of the partly non-tooth gear portion 69.

The second detectable portion 73 extends from the cylindrical portion 71 on the left end face of the raised portion 70 in a substantially opposite direction to the direction in which the first detectable portion 72 extends. In the rotating direction of the detectable rotary member 50, a distal end portion 73A of the second detectable portion 73 is provided in the same position as a central portion of the non-tooth portion 77 of the partly non-tooth gear portion 69. In addition, the distal end portion 73A projects to the outside of a rotating locus drawn by the first detectable portion 72 when the detectable rotary member 50 rotates to thereby constitute an abutment portion with which an interference member 91 (described later) is brought into abutment.

The third detectable portion 74 is provided upstream of the first detectable portion 72 and downstream of the second detectable portion 73 in the rotating direction (counterclockwise in FIG. 2B) of the detectable rotary member 50 and extends in a direction which orthogonally intersects the direction in which the first detectable portion 72 extends and a direction in which the third detectable portion 74 extends.

(3) Wire Spring

As shown in FIG. 2D, a cylindrical boss 83 is formed on the outer side of the first side wall 41 so as to project therefrom in front of the detectable rotary member 50. A wire spring 84 (an example of a holding member) is wound round the boss 83. One end portion of the wire spring 84 is fixed to the first side wall 41. The other end portion of the wire spring 84 extends towards the rotation shaft 68 of the detectable rotary member 50. The wire spring 84 is curved at an intermediate portion along the length thereof. A distal end portion of the wire spring 84 is brought into abutment with the pressed portion 79 of the partly non-tooth gear portion 69 from a front side thereof to thereby press the pressed portion 79 to the rear.

(4) Gear Cover

As shown in FIG. 2B, a gear cover 85 is attached to the outer side of the first side wall 41. The gear cover 85 covers the input gear 45, the supply gear 47, the intermediate gear 48, the agitator gear 49, the detectable rotary member 50 and the wire spring 84 altogether. Formed in this gear cover 85 are an opening 86 which enables the coupling portion 54 of the input gear 45 to be exposed and an opening 87 which enables the raised portion 70, the cylindrical portion 71, the first detectable portion 72, the second detectable portion 73 and the third detectable portion 74 of the detectable rotary member 50 to be exposed.

3. INTERFERENCE MEMBER

Figure 3A:
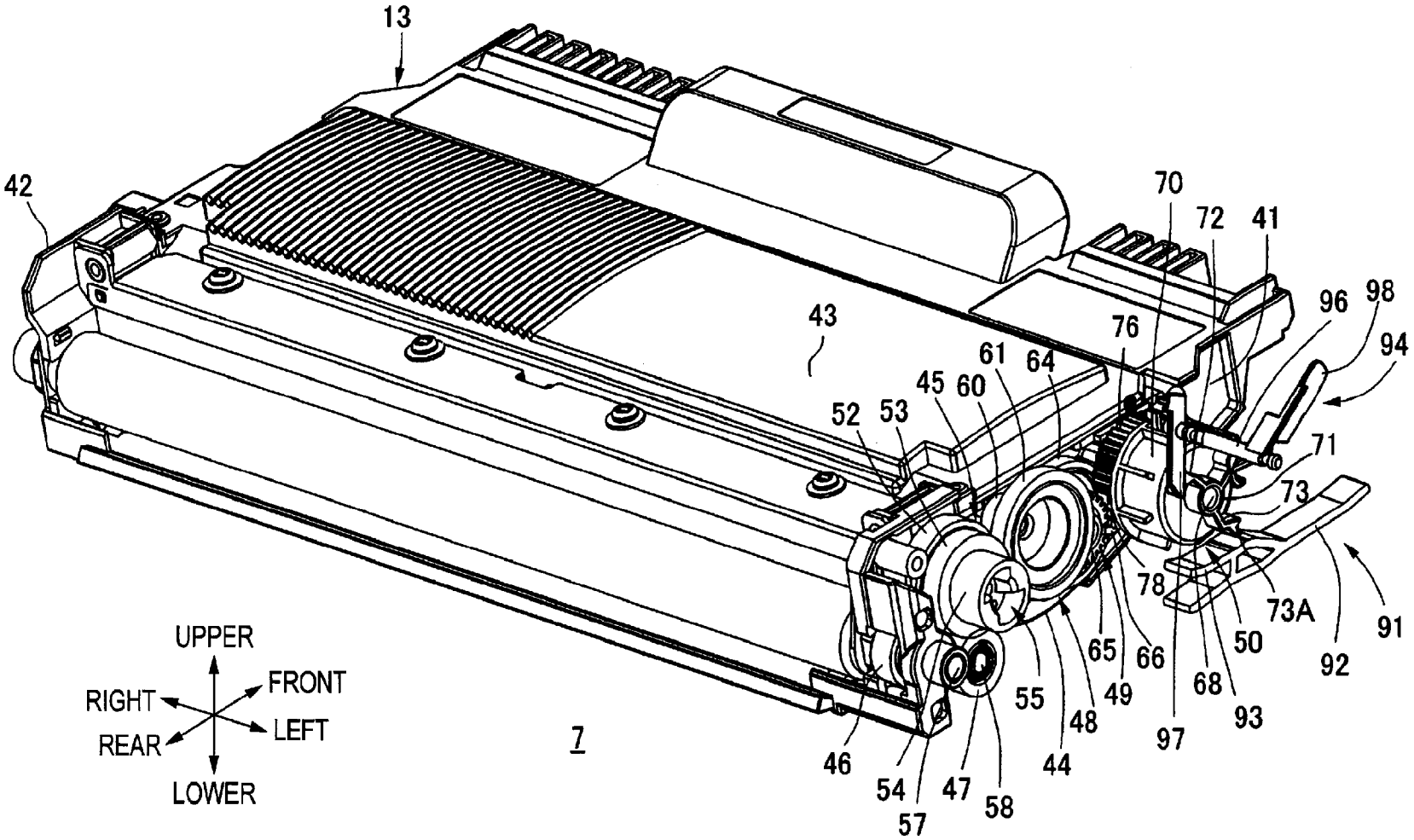
FIG. 3A is a perspective view of the developing cartridge as viewed from the left rear thereof which shows a state immediately after the developing cartridge is mounted in a body casing.

As shown in FIG. 3A, the interference member 91 is provided in the body casing 2 in a position which opposes the first side wall 41 of the developing cartridge 7 in the left-right direction and opposes the second detectable portion 73 in an up-down direction. The interference member 91 includes a support portion 92 and an operating portion 93. The support portion 92 has a plate shape, is thick in the up-down direction and extends in the front-rear direction. The operating portion 93 has a plate shape, extends obliquely upwards and rearwards from an intermediate portion in the front-rear direction on an upper surface of the support portion 92 and is bent to extend further to the rear with a space defined between the support portion 92 and itself.

4. DETECTION MECHANISM

Figure 3B:
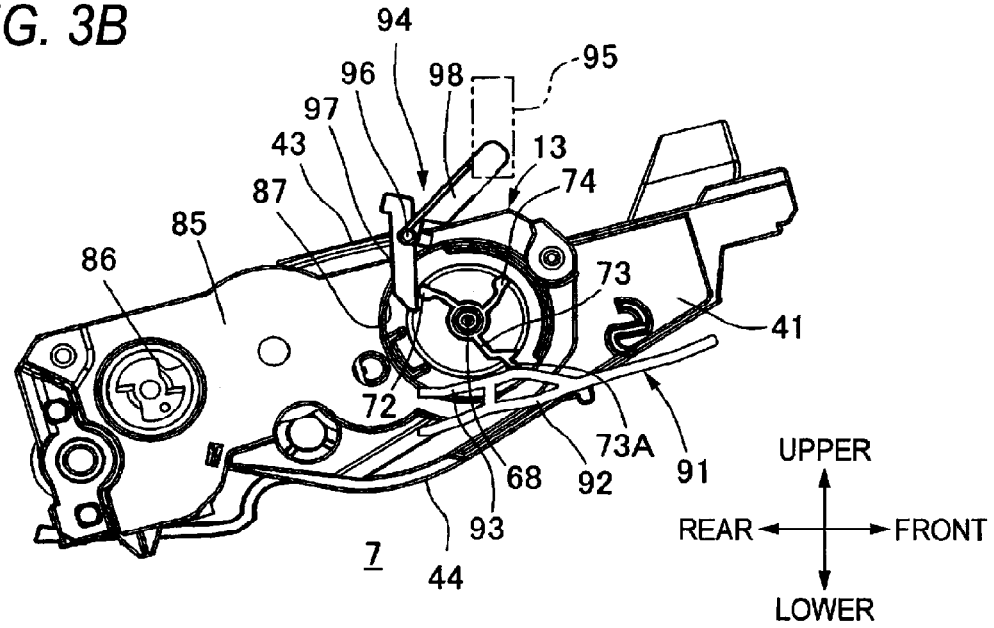
FIG. 3B is a left side view of the developing cartridge shown in FIG. 3A with a gear cover attached.
Figure 3C:
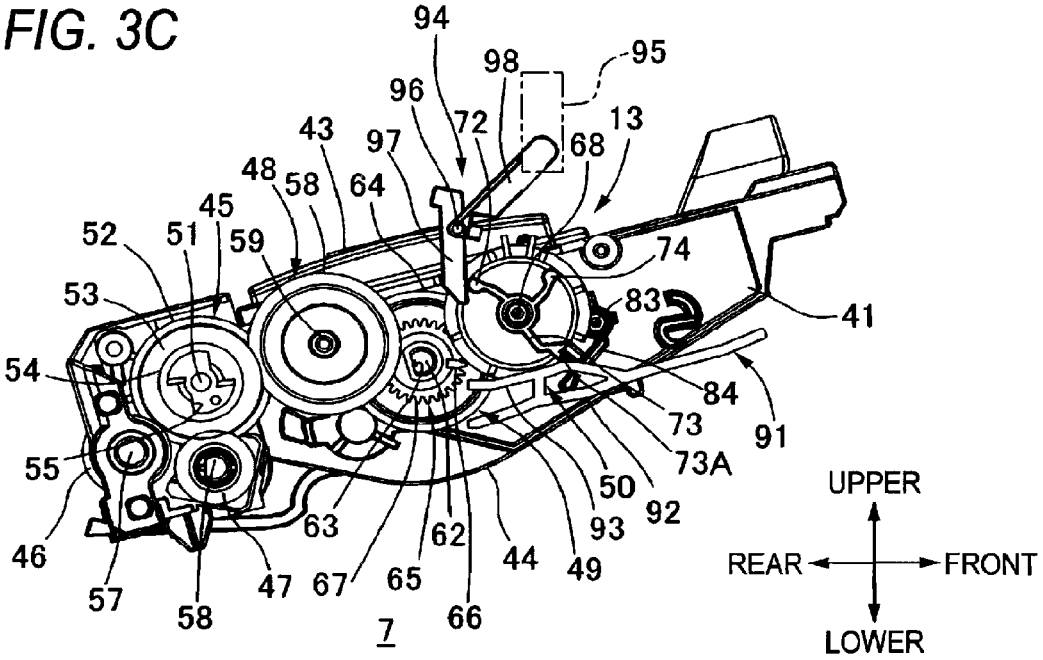
FIG. 3C is a left side view of the developing cartridge shown in FIG. 3A.

As shown in FIGS. 3A to 3C, a detection mechanism is provided in the body casing 2 for detecting the first detectable portion 72, the second detectable portion 73 and the third detectable portion 74. This detection mechanism includes an actuator 94 and a light sensor 95 (an example of a detection member).

The actuator 94 integrally includes a swing shaft 96 which extends in the left-right direction, an abutment lever 97 which extends downwards from a right end portion of the swing shaft 96 and an optical path interruption lever 98 which extends upwards from a portion of the swing shaft 96 which is spaced away to the left from the portion where the abutment lever 97 is connected. The swing shaft 96 is held rotatably on an inner wall portion (not shown) of the body casing 2. The abutment lever 97 and the optical path interruption lever 98 intersect each other at an angle of about 130.degree.

The actuator 94 can swing to a detecting posture in which the abutment lever 97 extends substantially perpendicularly downwards from the swing shaft 96 and the optical path interruption lever 98 extends forwards and upwards from the swing shaft 96 as shown in FIG. 3C and a non-detecting posture in which the optical path interruption lever 98 extends substantially perpendicularly upwards from the swing shaft 96 and the abutment lever 97 extends forwards and downwards from the swing shaft 96. The actuator 94 is designed to take the non-detecting posture by a spring force of a spring (not shown) in such a state that no other external force than the spring force is exerted thereon.

The light sensor 95 includes a light emitting element and a light receiving element which are provided to oppose each other in the left-right direction. The light sensor 95 is provided in a position where an optical path extending from the light emitting element to the light receiving element is interrupted by the optical path interruption lever 98 of the actuator 94 which is taking the detecting posture. The light sensor 95 continues to output an ON signal while the optical path extending from the light emitting element to the light receiving element is being interrupted by the optical path interruption lever 98 and continues to output an OFF signal while the optical path is not interrupted (light from the light emitting element reaches the light receiving element).

5. DETECTION OF MOUNTING OF DEVELOPING CARTRIDGE AND DETECTION OF WHETHER DEVELOPING CARTRIDGE IS NEW OR USED

As shown in FIGS. 2A to 2C, with a new developing cartridge 7, the second detectable portion 73 extends perpendicularly downwards from the cylindrical portion 71. In addition, as shown in FIG. 2D, with a new developing cartridge 7, the engagement portion 78 is provided in the position situated outside the rotating locus drawn by the engagement portion 66 when the agitator gear 49 rotates. Specifically, the engagement portion 78 is situated in such a position as to oppose an upper end portion of the small-diameter gear portion 65 of the agitator gear 49 in the front-rear direction when viewed from a side thereof.

A rotating position of the detectable rotary member 50 when the engagement portion 78 is provided in the above position corresponds to an example of a third rotational position which is different from a first rotational position and a second rotational position (described later).

Figure 3D:
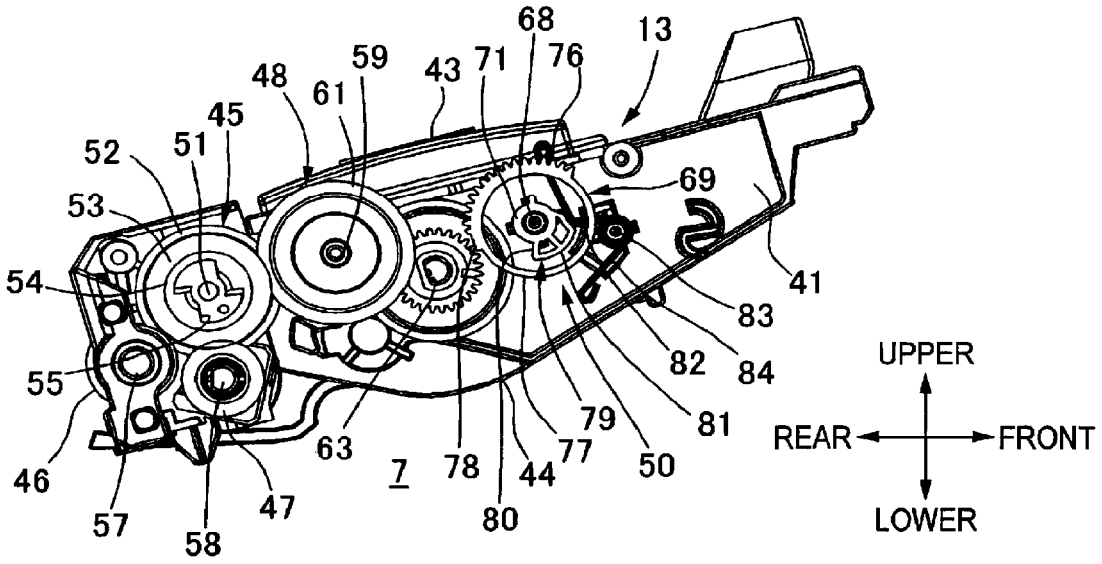
FIG. 3D is a left side of the developing cartridge shown in FIG. 3A with a part of the detectable rotary member detached.

The developing cartridge 7 is mounted in the body casing 2 with the front cover 4 open. When a new developing cartridge 7 is mounted in the body casing 2, in the midst of mounting thereof, as shown in FIGS. 3A to 3C, the distal end portion 73A of the second detectable portion 73 is brought into abutment with an upper surface of a sloping portion of the operating portion 93 of the interference member 91. By a rearward movement of the developing cartridge 7 as a result of mounting thereof into the body casing 2, the distal end portion 73A of the second detectable portion 73 slides on an upper surface of the sloping portion of the operating portion 93 in a rubbing manner and is lifted upwards in accordance with the inclination of the sloping surface. By the distal end portion 73A being lifted upwards, the detectable rotary member 50 rotates clockwise when viewed in FIGS. 3B to 3D through about 10.degree. (T1 to T2 in FIG. 12), whereby the engagement portion 78 is provided on the rotating locus of the engagement portion 66 as shown in FIG. 3D.

When the mounting of the developing cartridge 7 is completed, as shown in FIGS. 3A to 3C, a distal end portion of the first detectable portion 72 is brought into abutment with a lower end portion of the abutment lever 97 of the actuator 94, whereby the lower end portion is pressed to the rear, causing the actuator 94 to take the detecting posture. As a result, the optical path extending from the light emitting element to the light receiving element is interrupted by the optical path interruption lever 98, whereby an ON signal is outputted from the light sensor 95 (T1 in FIG. 12). In this way, an indirect detection of the first detectable portion by the light sensor 95 is performed.

The rotational position of the detectable rotary member 50 corresponds to an example of a first rotational position where the first detectable portion 72 is detected by the light sensor 95, and a non-driven position where the transmission of the driving force from the agitator gear 49 to the detectable rotary member 50 is cut off.

When the mounting of the developing cartridge 7 is completed and the front cover 4 is closed, a warming-up operation of the laser printer 1 is started. In this warming-up operation, the driving force output member (refer to FIG. 2A) is inserted in the coupling recess portion 55 of the input gear 45 so that a driving force is inputted into the input gear 45 from the driving force output member 56, whereby the input gear 45 rotates. Then, the developing gear 46, the supply gear 47 and the intermediate gear 48 rotate in association with the rotation of the input gear 45, whereby the developing roller 18 and the supply roller 19 rotates. The agitator gear 49 rotates (T3 in FIG. 12) in association with the rotation of the intermediate gear 48, whereby the agitator 16 (refer to FIG. 1) rotates. Toner in the developing cartridge 7 is loosened by the rotation of the agitator 16.

Figure 4A:
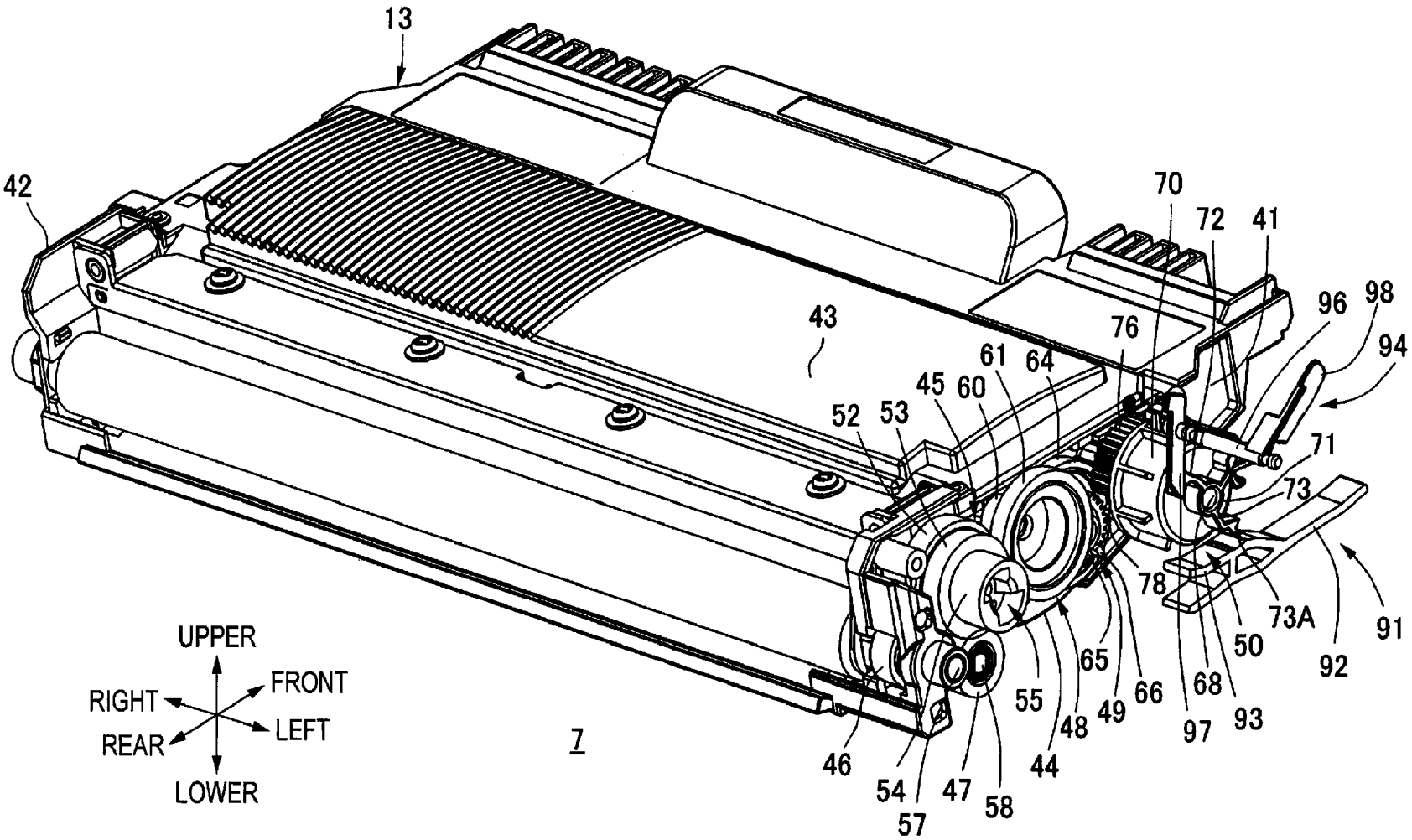
FIG. 4A is a perspective view of the developing cartridge as viewed from the left rear thereof which shows a state following the state shown in FIG. 3A.
Figure 4B:
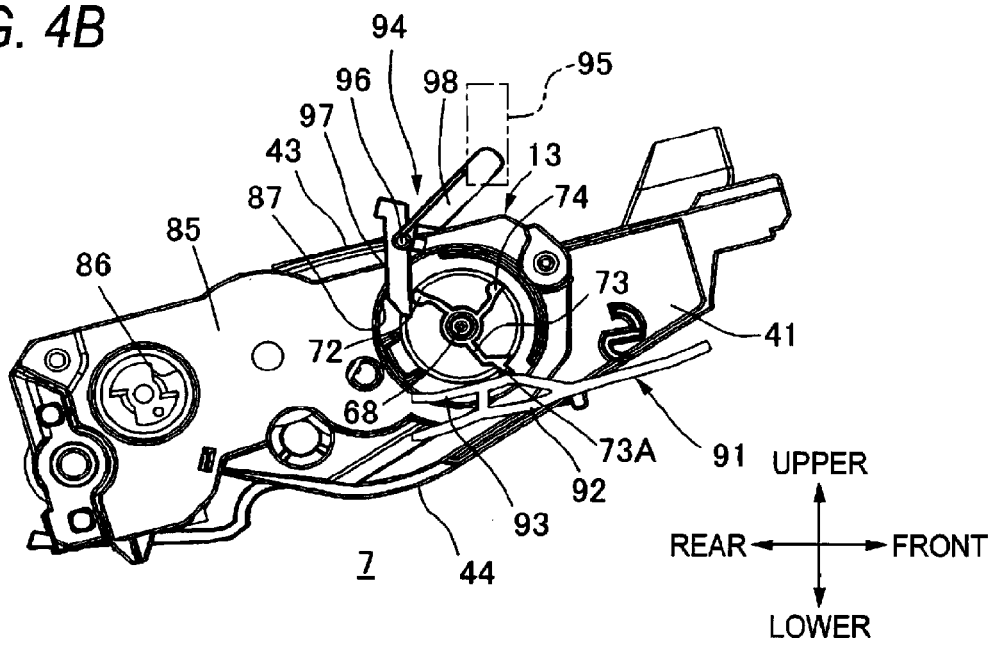
FIG. 4B is a left side view of the developing cartridge shown in FIG. 4A with the gear cover attached.
Figure 4C:
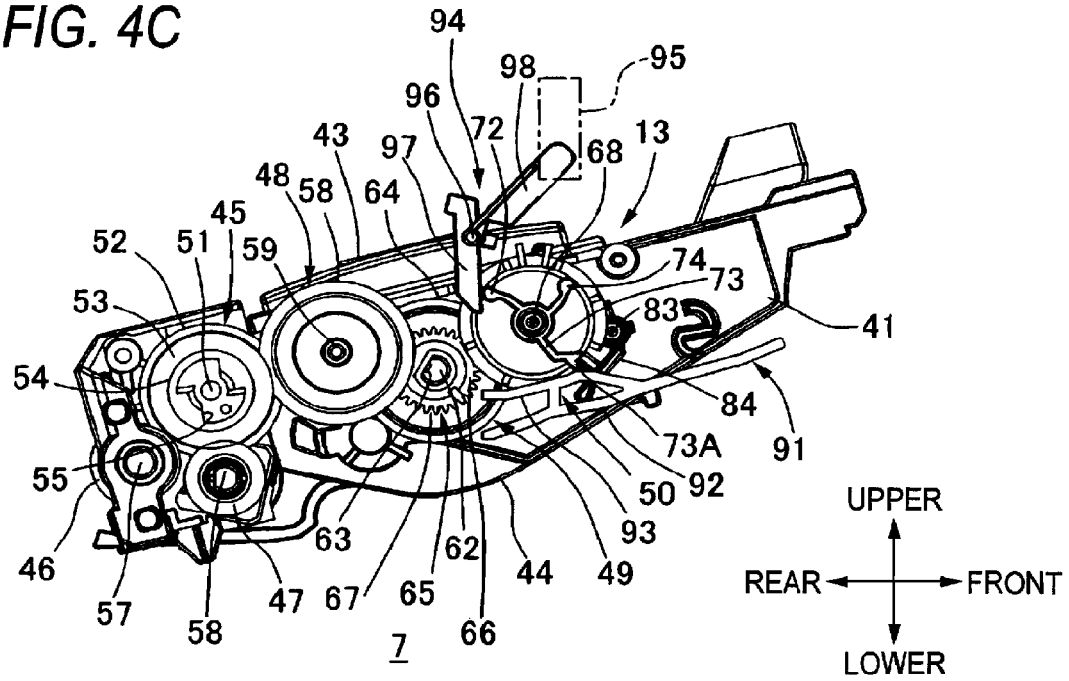
FIG. 4C is a left side view of the developing cartridge shown in FIG. 4A.
Figure 4D:
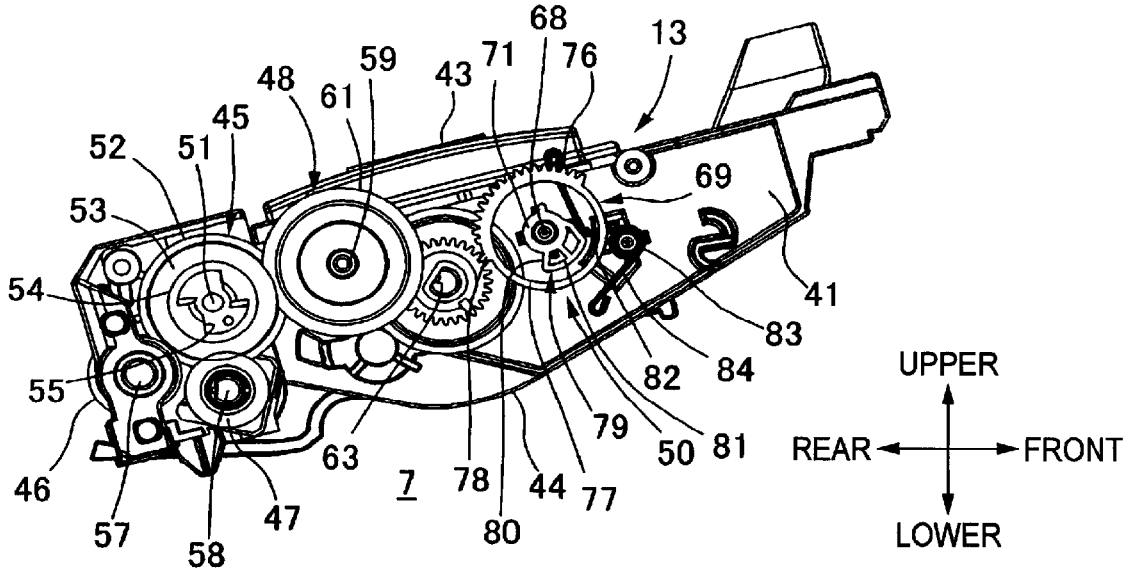
FIG. 4D is a left side of the developing cartridge shown in FIG. 4A with a part of the detectable rotary member detached.
Figure 5A:
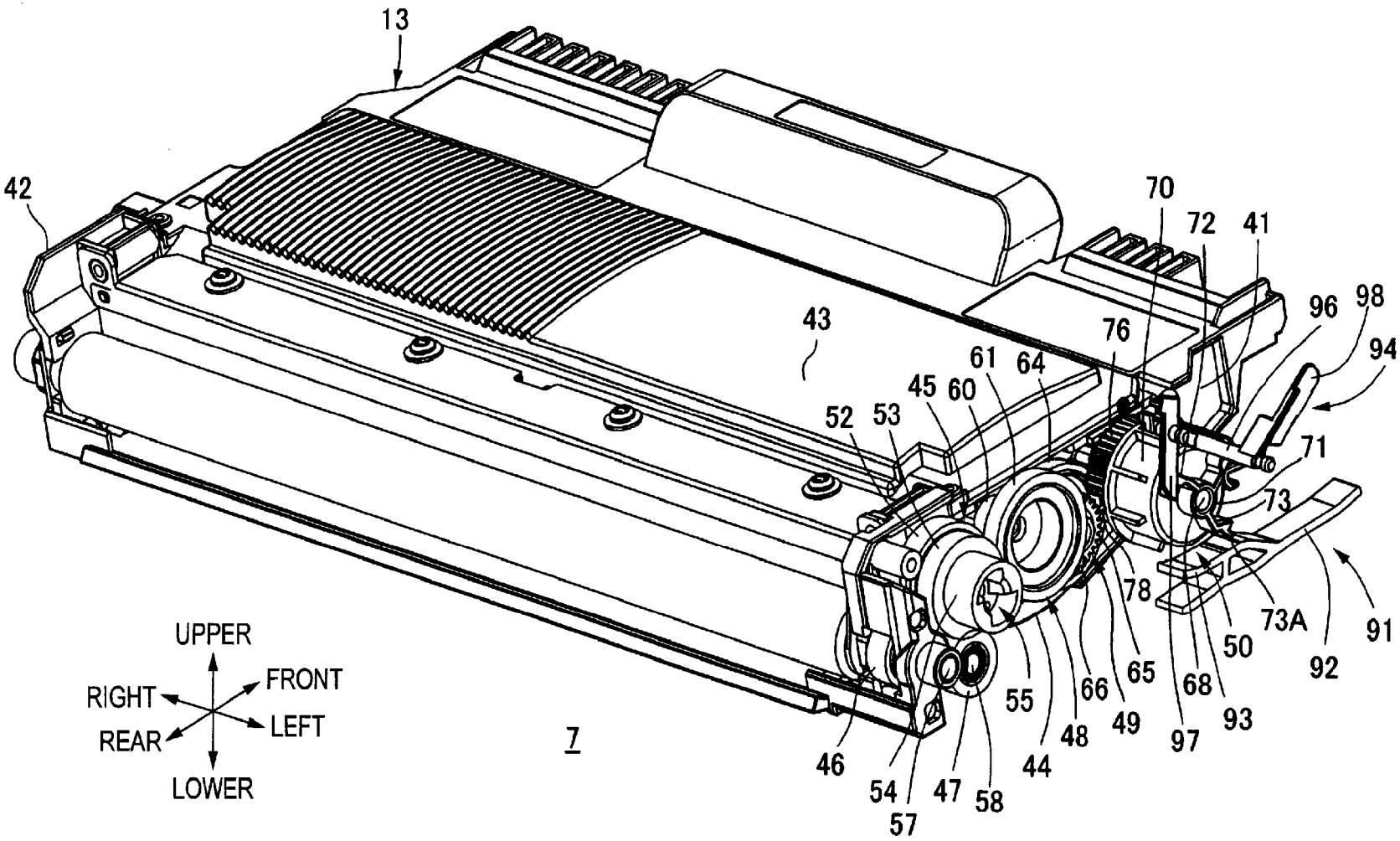
FIG. 5A is a perspective view of the developing cartridge as viewed from the left rear thereof which shows a state following the state shown in FIG. 4A.
Figure 5B:
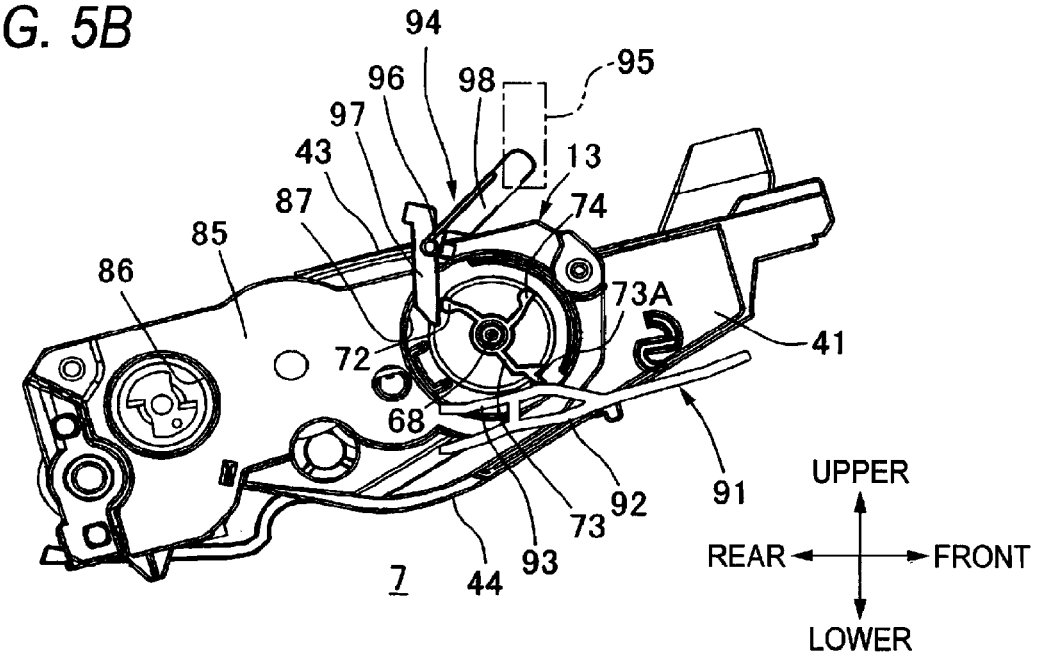
FIG. 5B is a left side view of the developing cartridge shown in FIG. 5A with the gear cover attached.
Figure 5C:
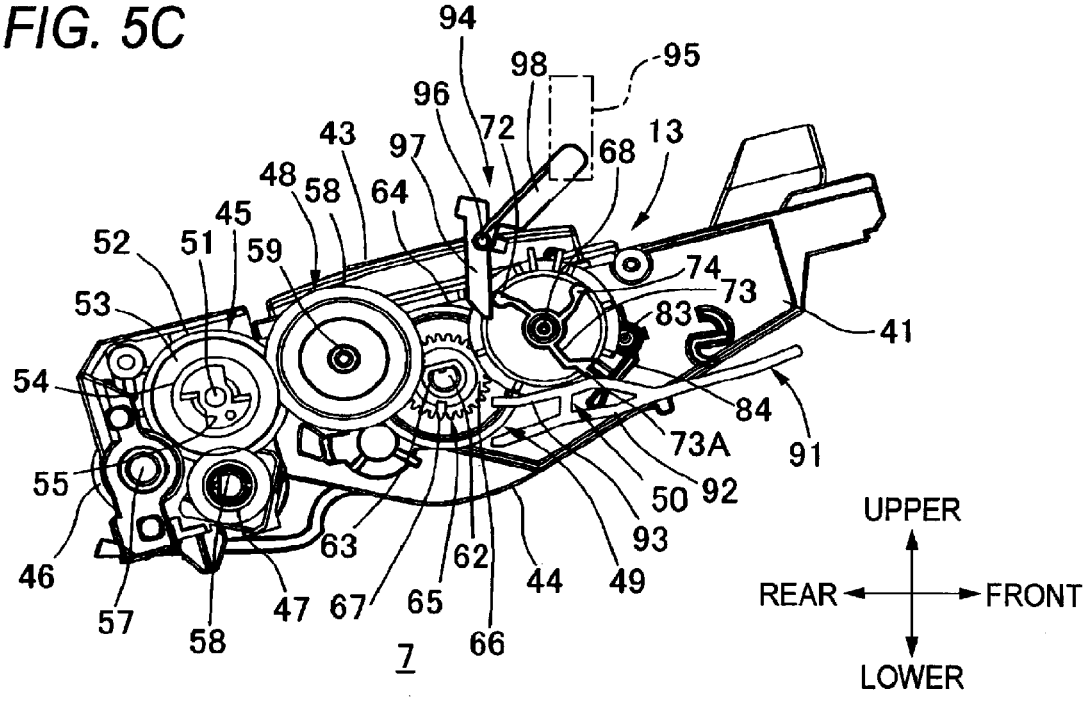
FIG. 5C is a left side view of the developing cartridge shown in FIG. 5A.
Figure 5D:
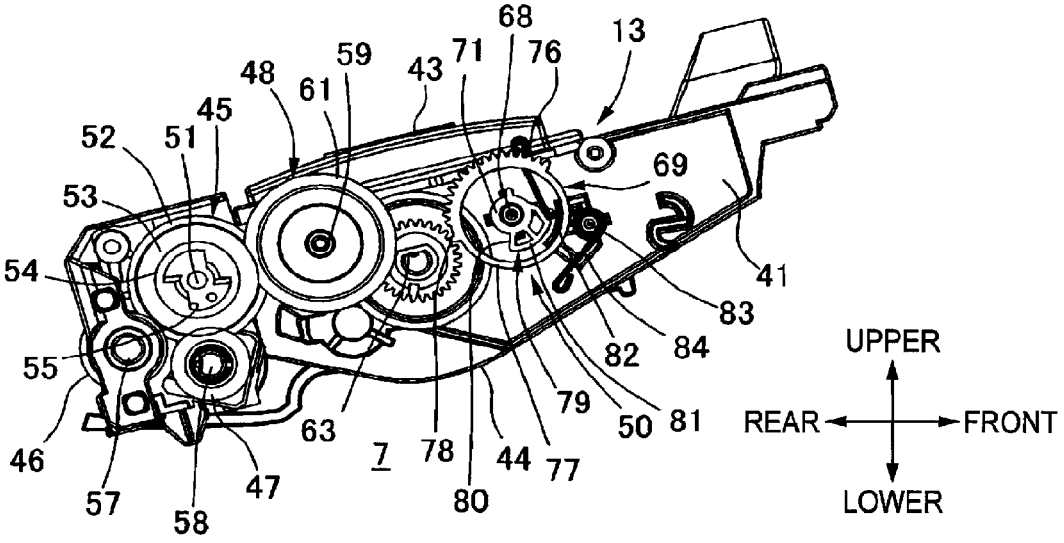
FIG. 5D is a left side of the developing cartridge shown in FIG. 5A with a part of the detectable rotary member detached.
Figure 6A:
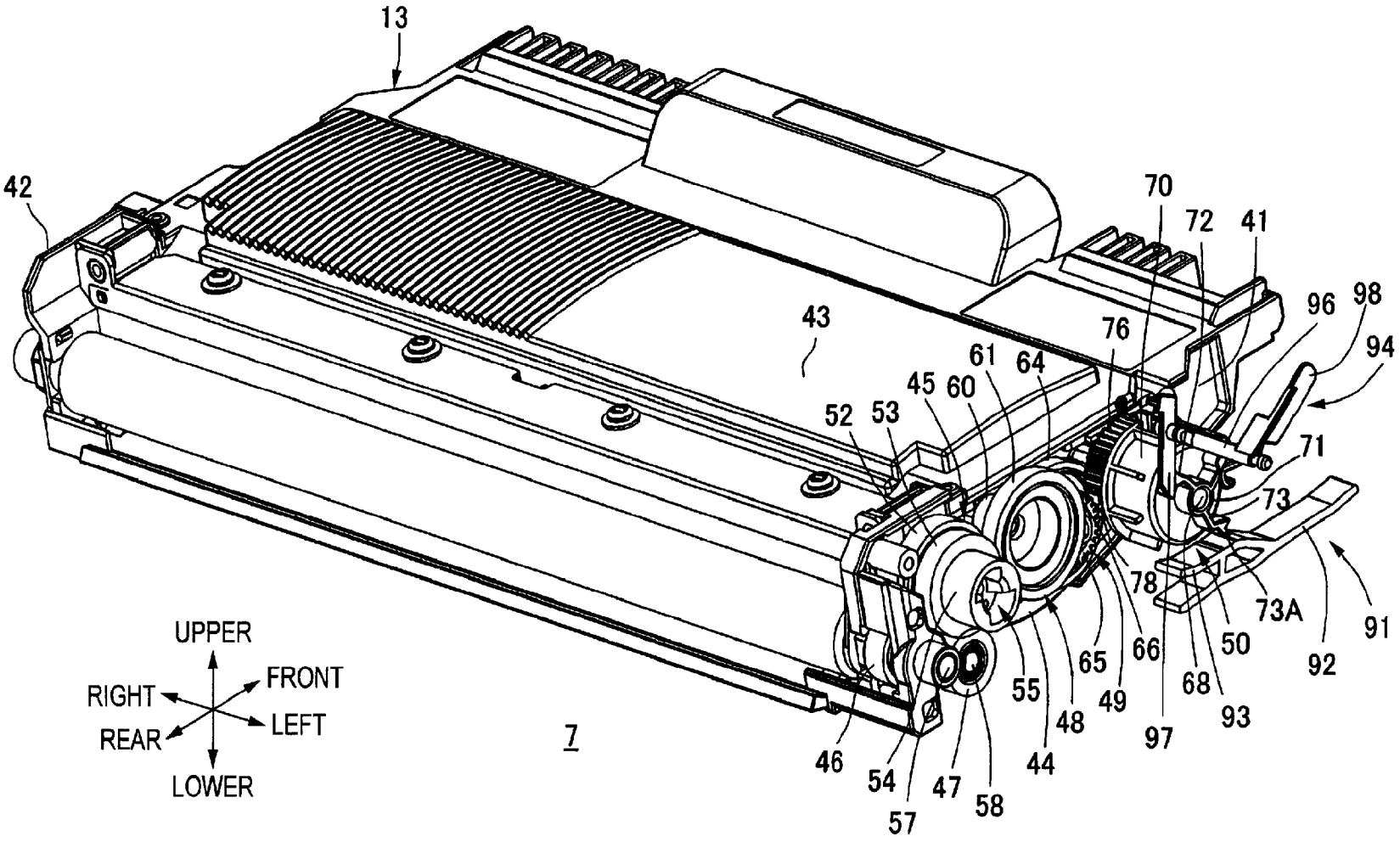
FIG. 6A is a perspective view of the developing cartridge as viewed from the left rear thereof which shows a state following the state shown in FIG. 5A.
Figure 6B:
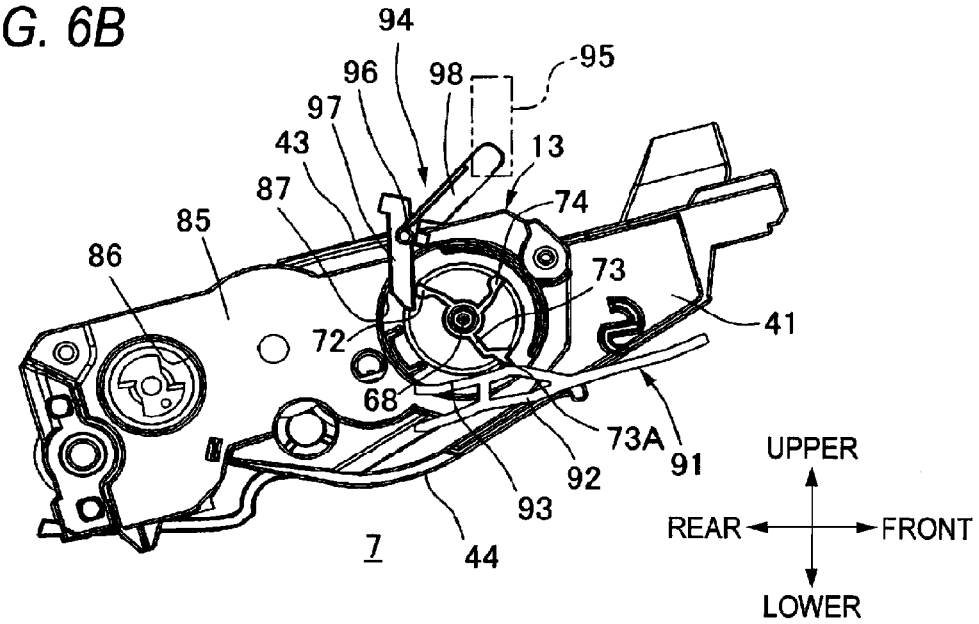
FIG. 6B is a left side view of the developing cartridge shown in FIG. 6A with the gear cover attached.
Figure 6C:
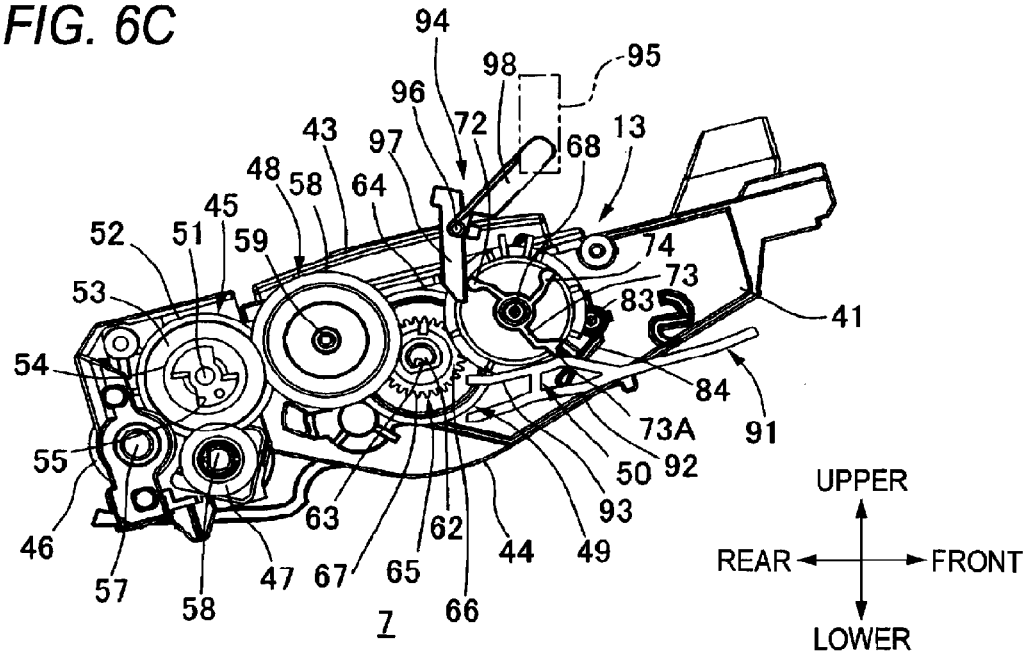
FIG. 6C is a left side view of the developing cartridge shown in FIG. 6A.
Figure 6D:
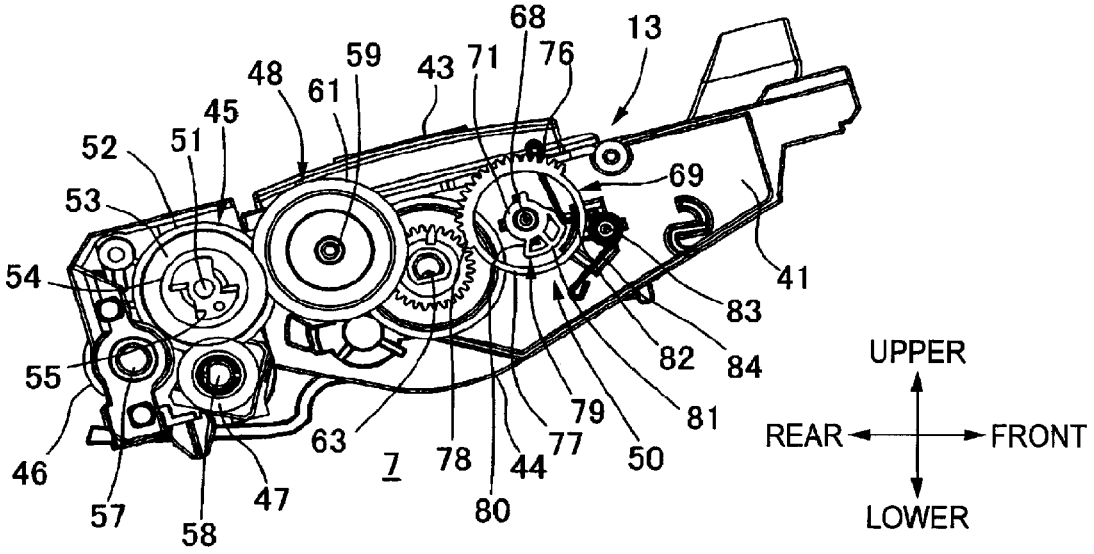
FIG. 6D is a left side of the developing cartridge shown in FIG. 6A with a part of the detectable rotary member detached.

As FIGS. 4C, 5C and 6C show sequential rotational positions of the agitator gear 49, the agitator gear 49 rotates clockwise in FIGS. 4C, 5C, 6C. As the agitator gear 49 rotates, the engagement portion 66 is not in contact with the engagement portion 78, and the gear teeth 76 of the partly non-tooth gear portion 69 of the agitator gear 49 do not mesh with the gear teeth 67 of the agitator gear 49. Therefore, as shown in FIGS. 4A to 4D, 5A to 5D and 6A to 6D, the detectable rotary member 50 does not rotate, and the rotational position of the detectable rotary member 50 does not change.

Figure 7A:
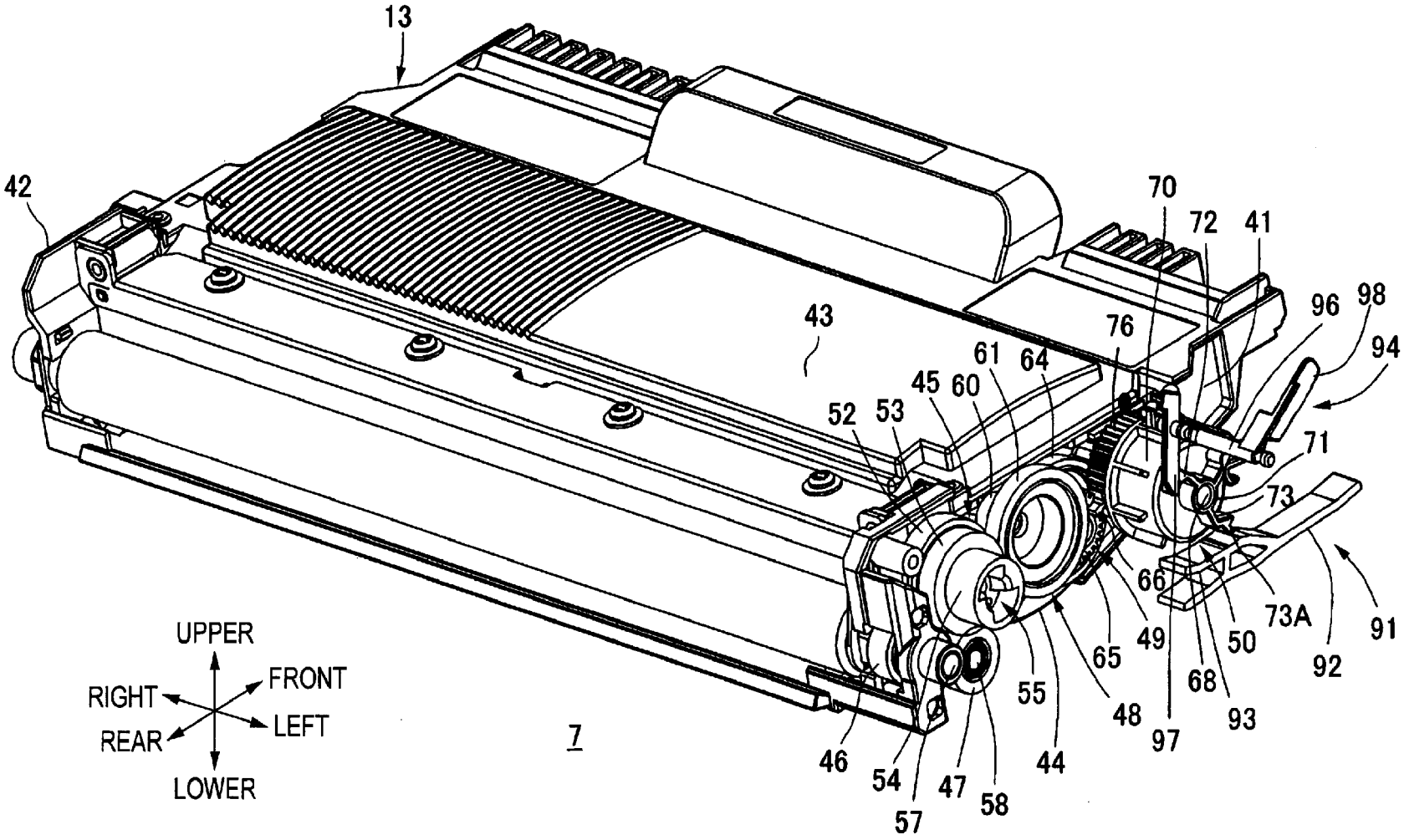
FIG. 7A is a perspective view of the developing cartridge as viewed from the left rear thereof which shows a state following the state shown in FIG. 6A.
Figure 7B:
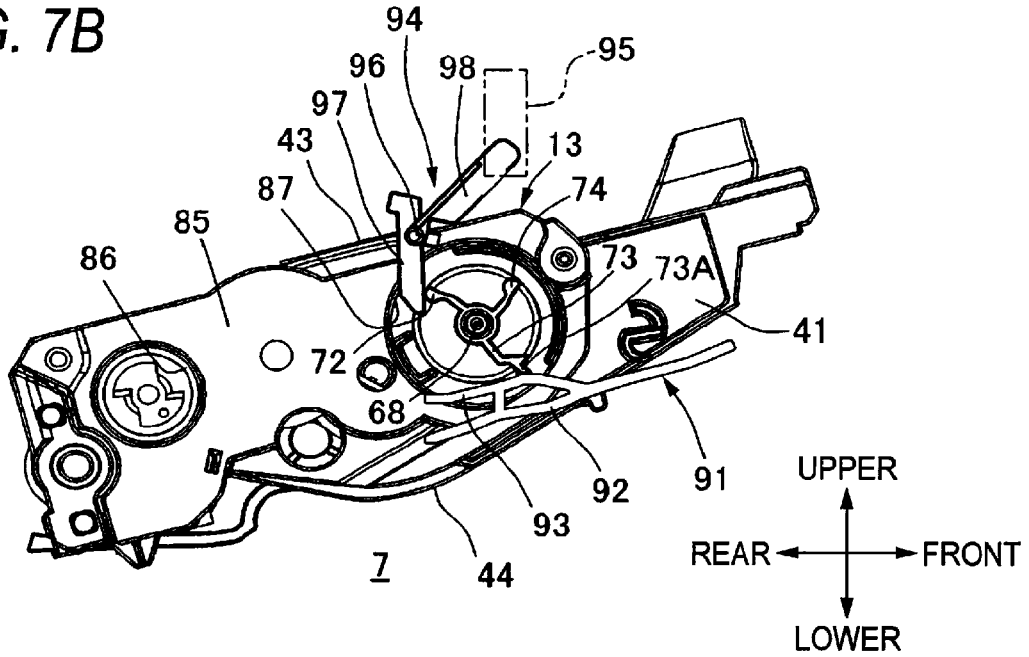
FIG. 7B is a left side view of the developing cartridge shown in FIG. 7A with the gear cover attached.
Figure 7C:
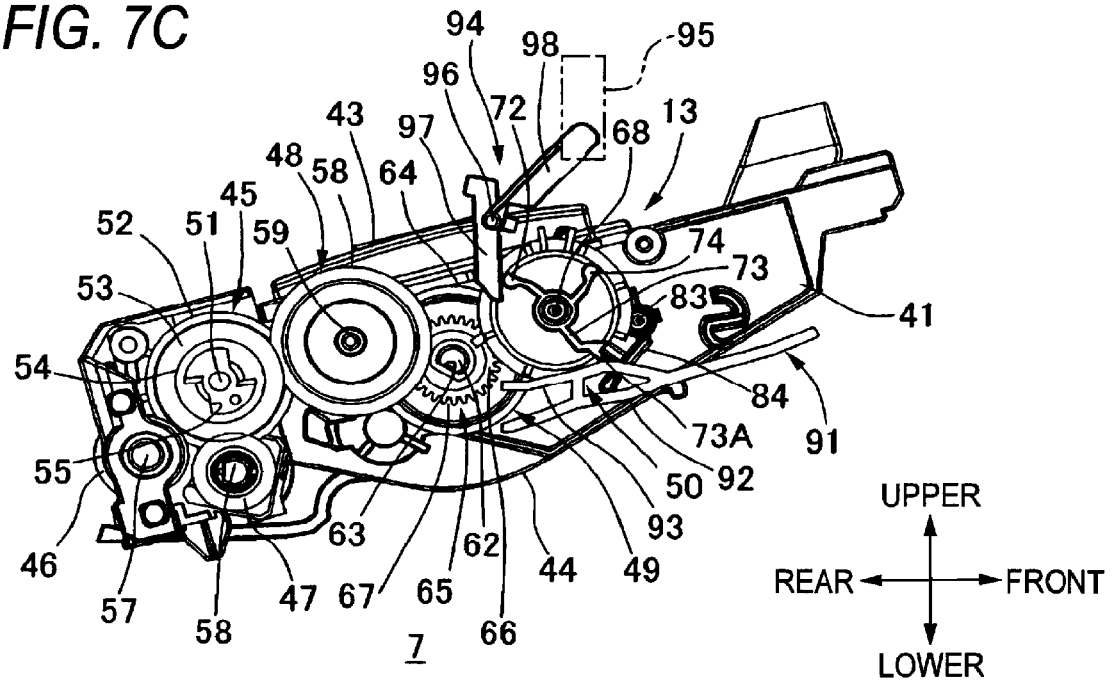
FIG. 7C is a left side view of the developing cartridge shown in FIG. 7A.
Figure 7D:
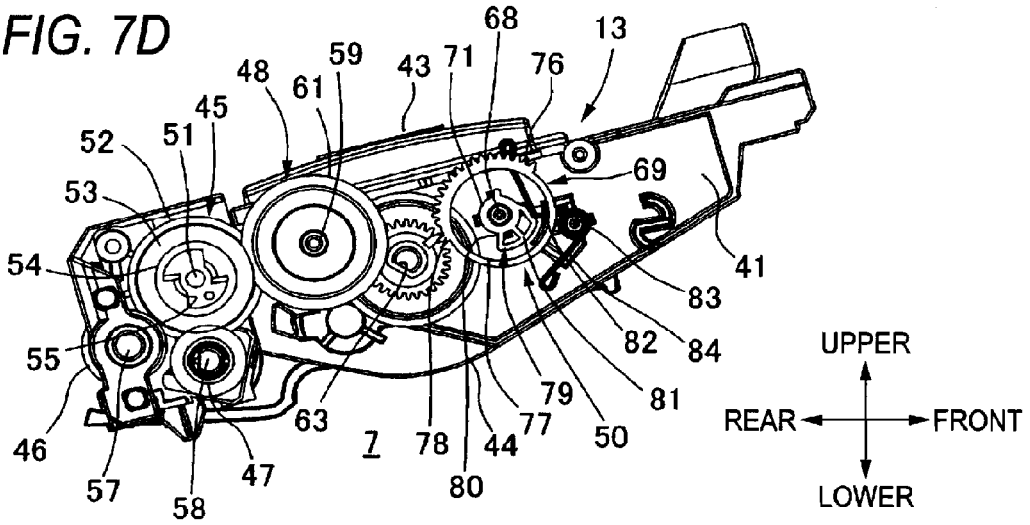
FIG. 7D is a left side of the developing cartridge shown in FIG. 7A with a part of the detectable rotary member detached.
Figure 7E:
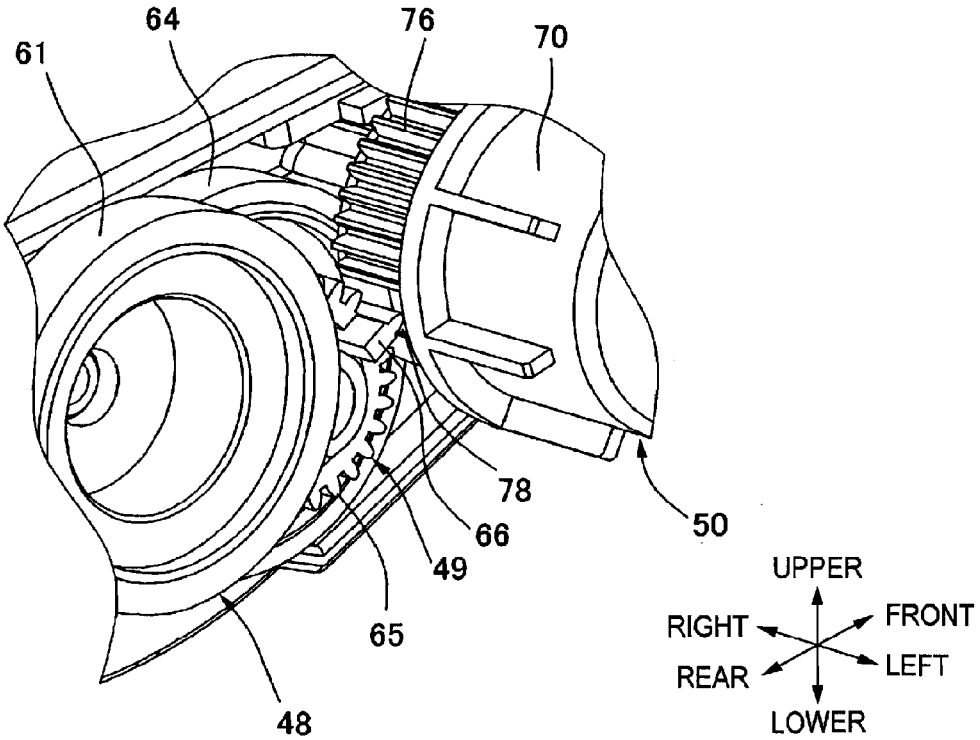
FIG. 7E is a perspective view of a part of the developing cartridge shown in FIG. 7A in an enlarged manner.

Then, when the rotation of the agitator gear 49 progresses, as shown in FIGS. 7A, 7C, 7D, the engagement portion 66 comes into abutment with the engagement portion 78. Specifically, as shown in FIG. 7E, the engagement portion 66 comes into abutment with the engagement portion from the above.

Figure 8A:
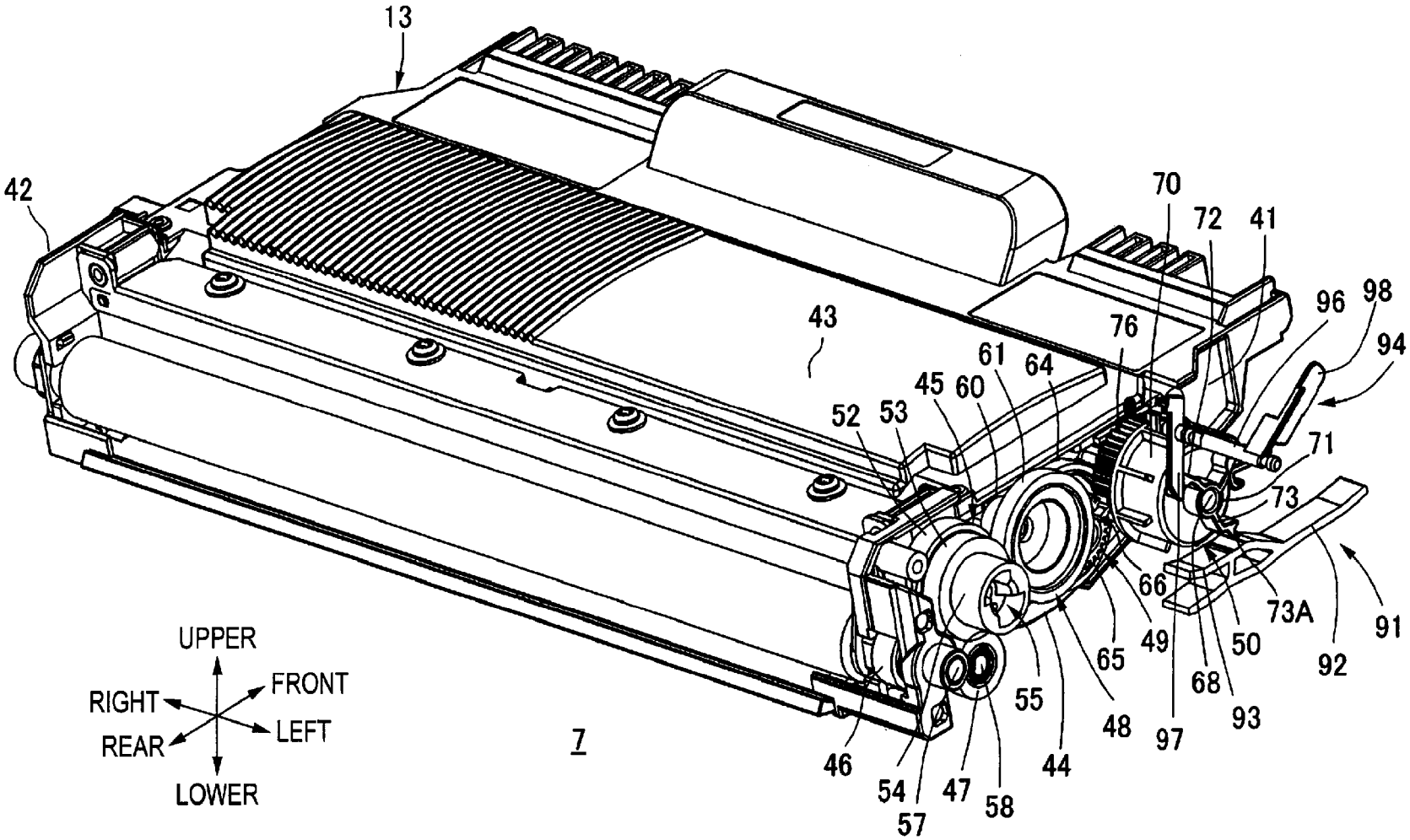
FIG. 8A is a perspective view of the developing cartridge as viewed from the left rear thereof which shows a state following the state shown in FIG. 7A.
Figure 8B:
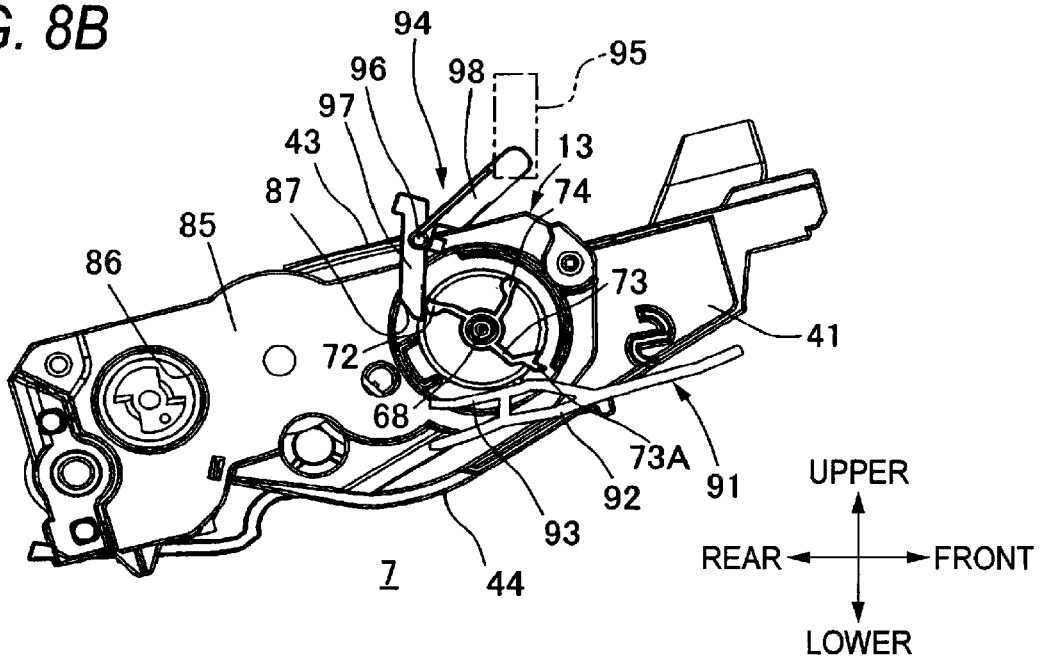
FIG. 8B is a left side view of the developing cartridge shown in FIG. 8A with the gear cover attached.
Figure 8C:
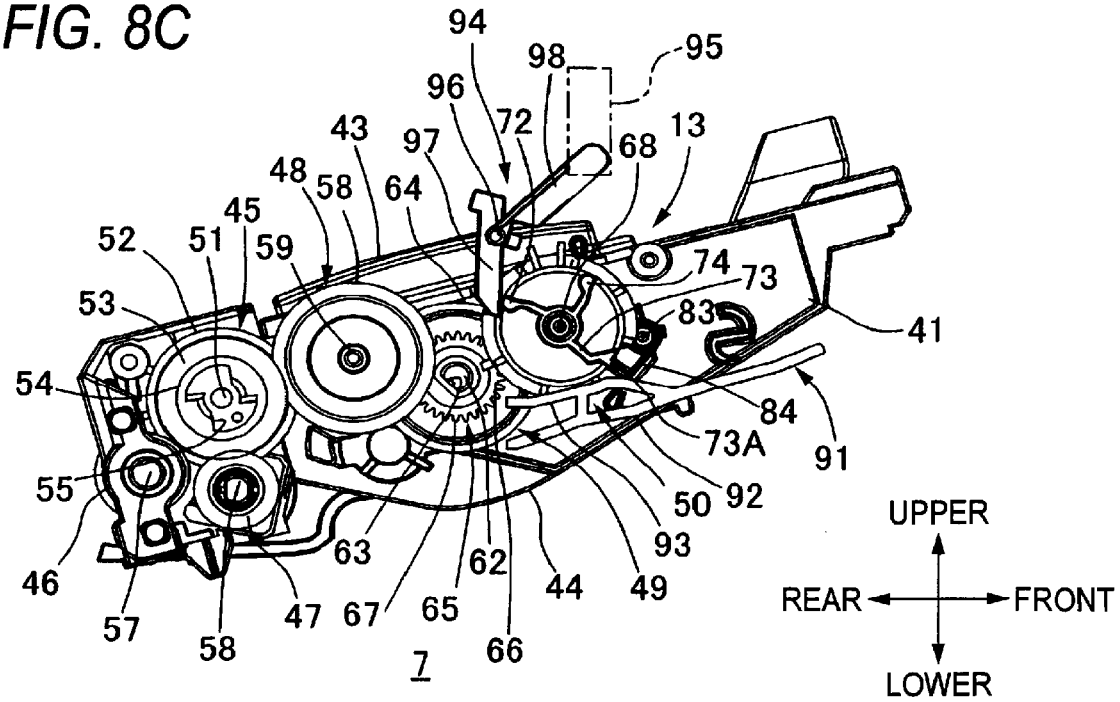
FIG. 8C is a left side view of the developing cartridge shown in FIG. 8A.
Figure 8D:
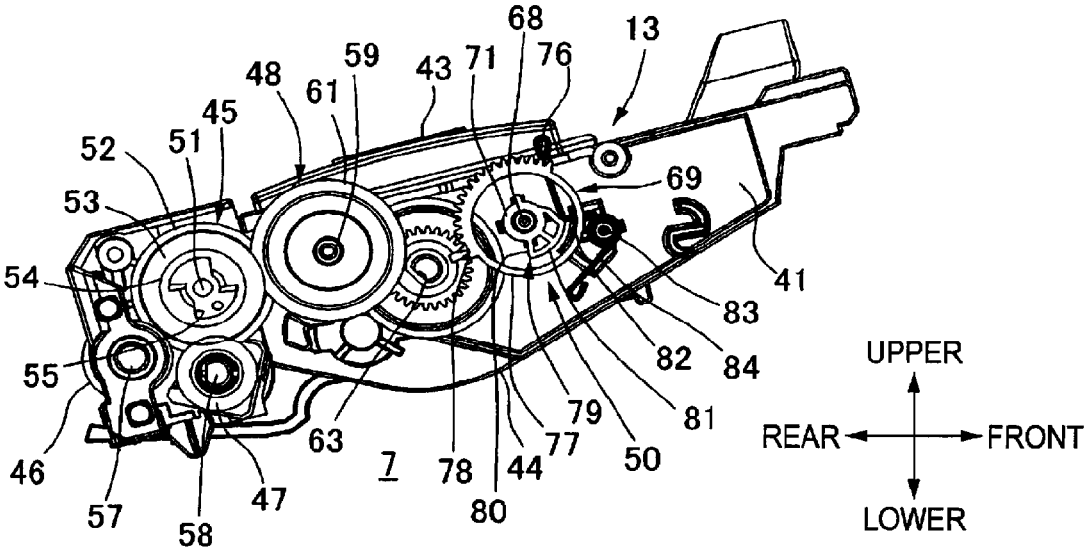
FIG. 8D is a left side of the developing cartridge shown in FIG. 8A with a part of the detectable rotary member detached.

Then, when the rotation of the agitator 49 progresses further, as shown in FIGS. 8A, 8C, 8D, the engagement portion 78 is pressed against by the engagement portion 66, and the detectable rotary member 50 rotates counterclockwise in FIGS. 8A, 8C, 8D (T4 in FIG. 12), whereby the gear teeth 76 of the partly non-tooth gear portion 69 of the detectable rotary member 50 mesh with the gear teeth 67 of the agitator gear 49.

This rotational position of the detectable rotary member 50 corresponds to an example of a driven position where the detectable rotary member 50 is rotated by the driving force transmitted from the agitator gear 49.

Figure 9A:
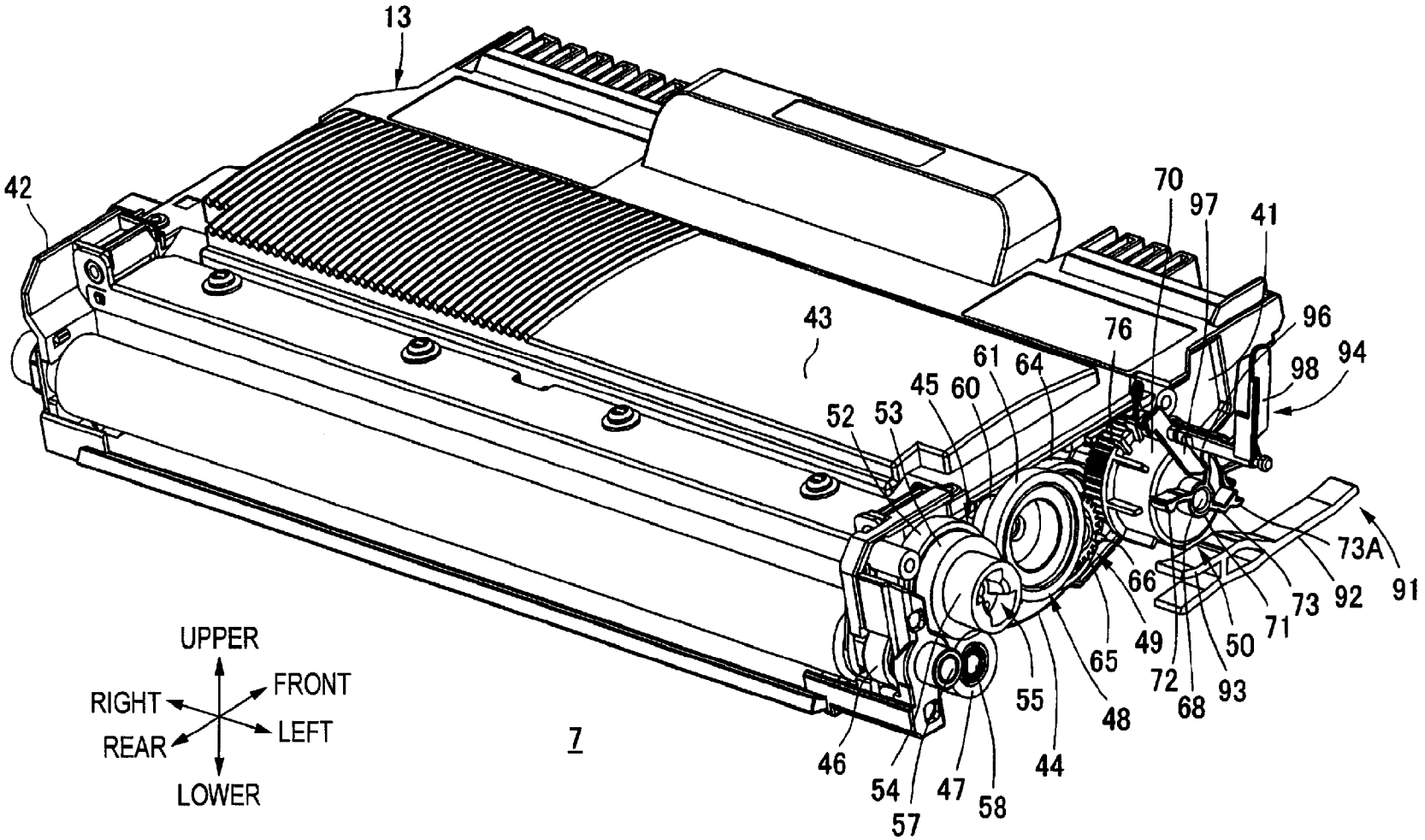
FIG. 9A is a perspective view of the developing cartridge as viewed from the left rear thereof which shows a state following the state shown in FIG. 8A.
Figure 9B:
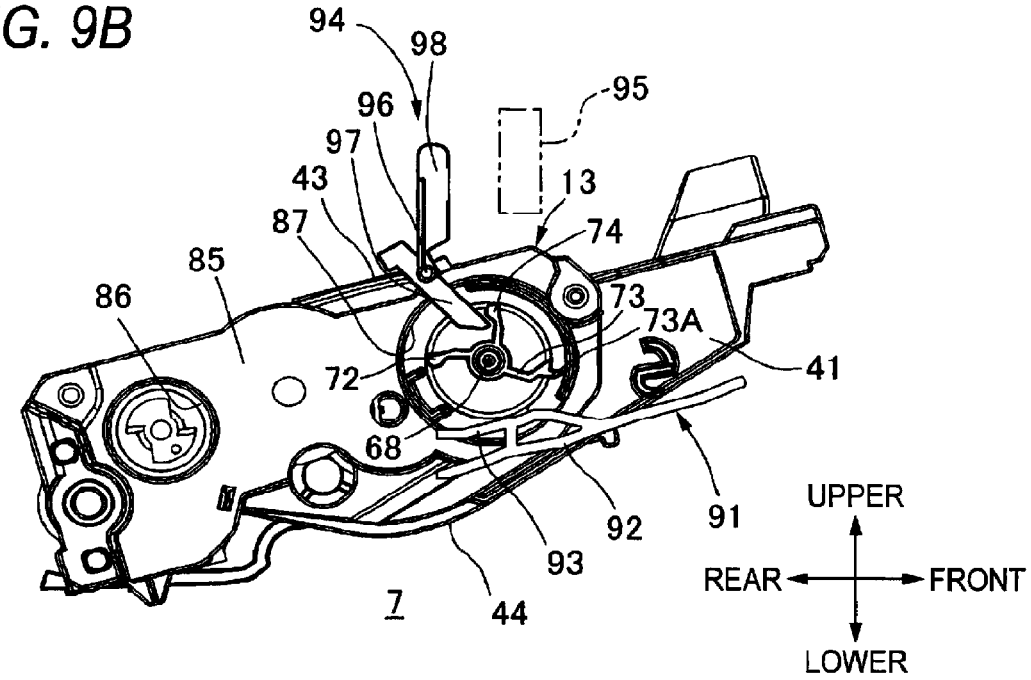
FIG. 9B is a left side view of the developing cartridge shown in FIG. 9A with the gear cover attached.
Figure 9C:
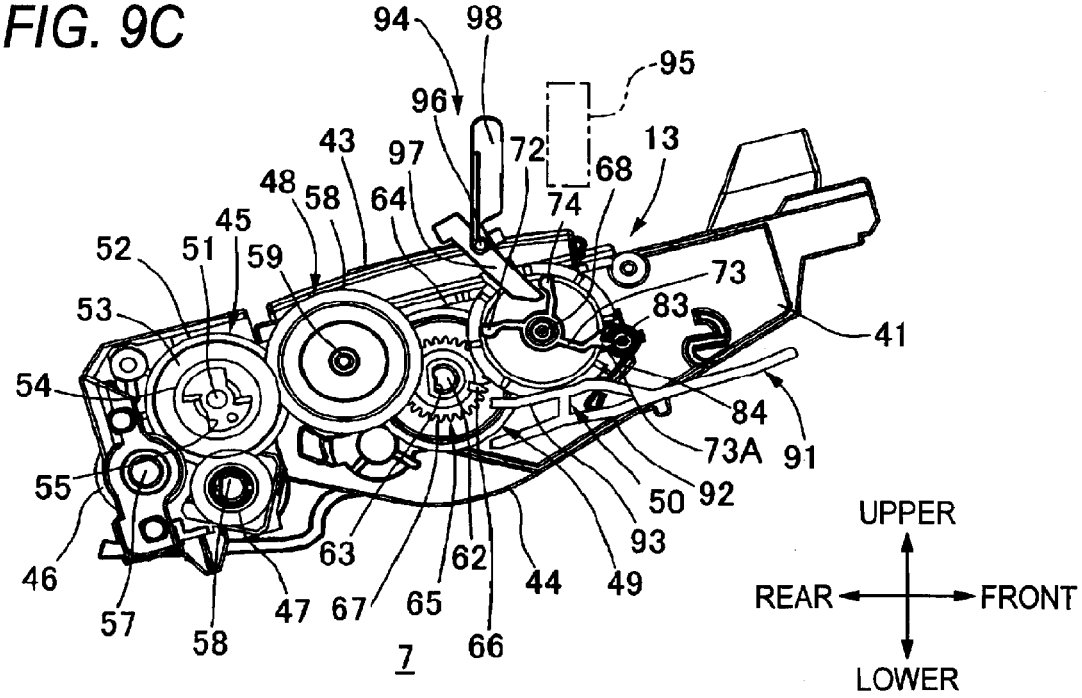
FIG. 9C is a left side view of the developing cartridge shown in FIG. 9A.
Figure 9D:
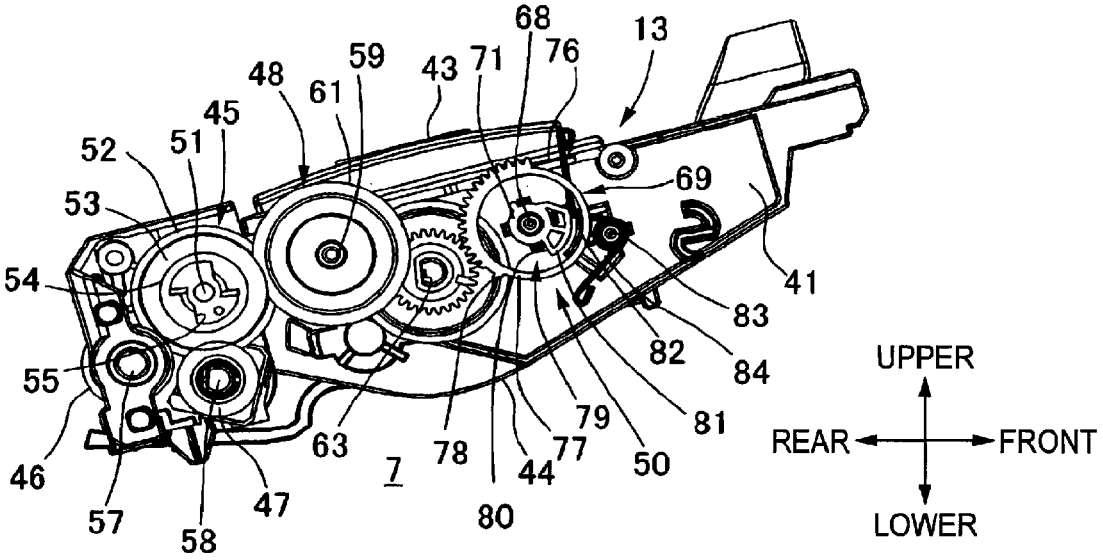
FIG. 9D is a left side of the developing cartridge shown in FIG. 9A with a part of the detectable rotary member detached.

Thereafter, the gear teeth 76 moves by following the rotation of the agitator gear 49, whereby the detectable rotary member 50 rotates. As a result of the rotation of the detectable rotary member 50, as shown in FIGS. 9A to 9C, the distal end portion of the first detectable portion 72 moves away from the abutment lever 97, and the actuator 94 changes its posture from the detecting posture to the non-detecting posture. As a result, the optical path interruption lever 98 moves out of the optical path which extends from the light emitting element to the light receiving element of the light sensor 95, whereby an OFF signal is outputted from the light sensor 95 (T5 in FIG. 12).

Figure 10A:
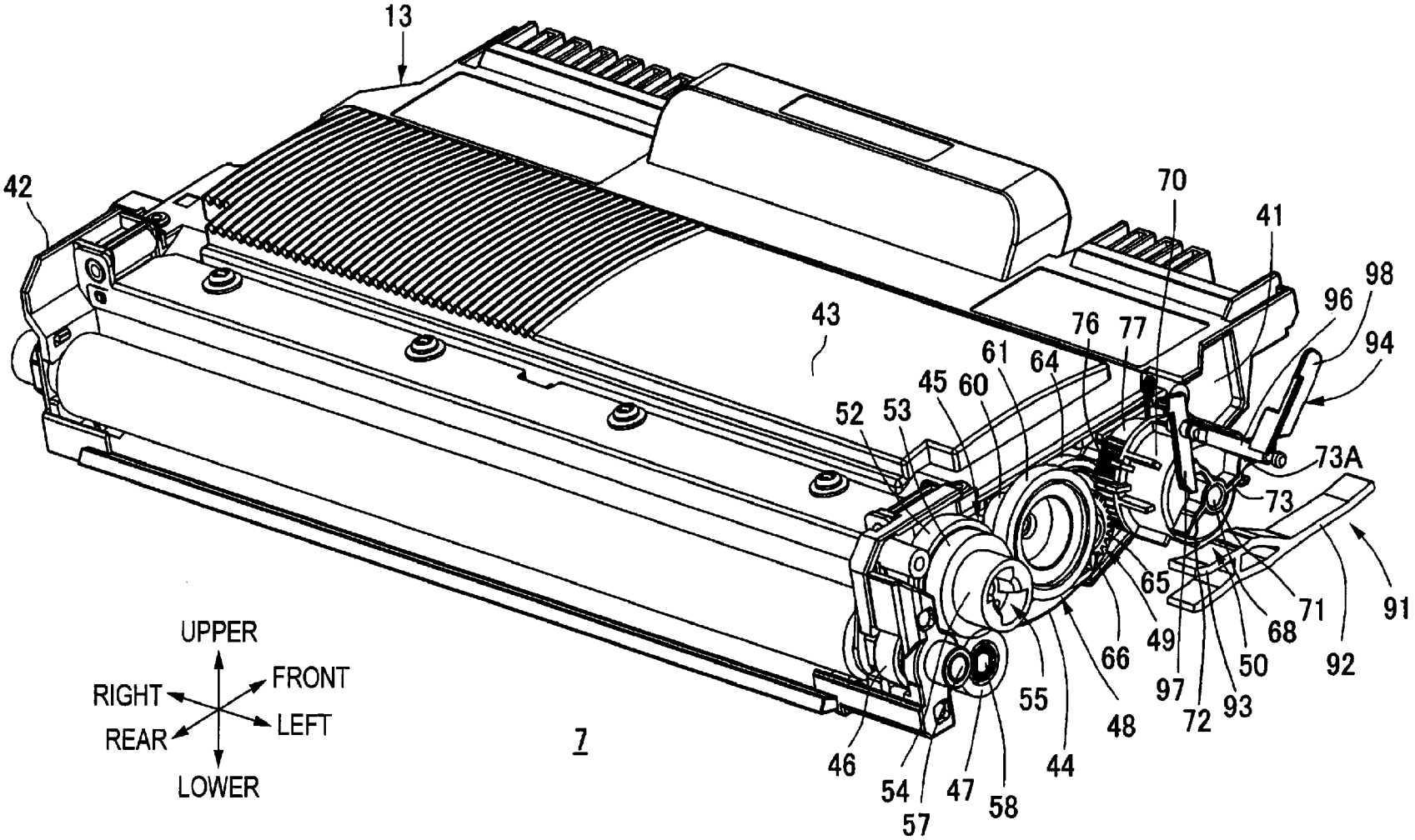
FIG. 10A is a perspective view of the developing cartridge as viewed from the left rear thereof which shows a state following the state shown in FIG. 9A.
Figure 10B:
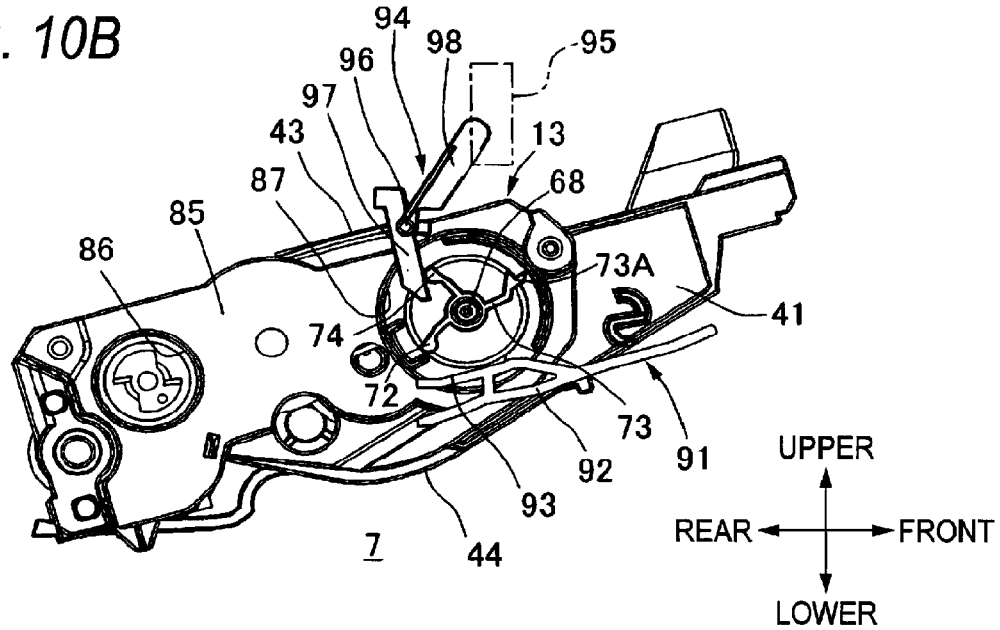
FIG. 10B is a left side view of the developing cartridge shown in FIG. 10A with the gear cover attached.
Figure 10C:
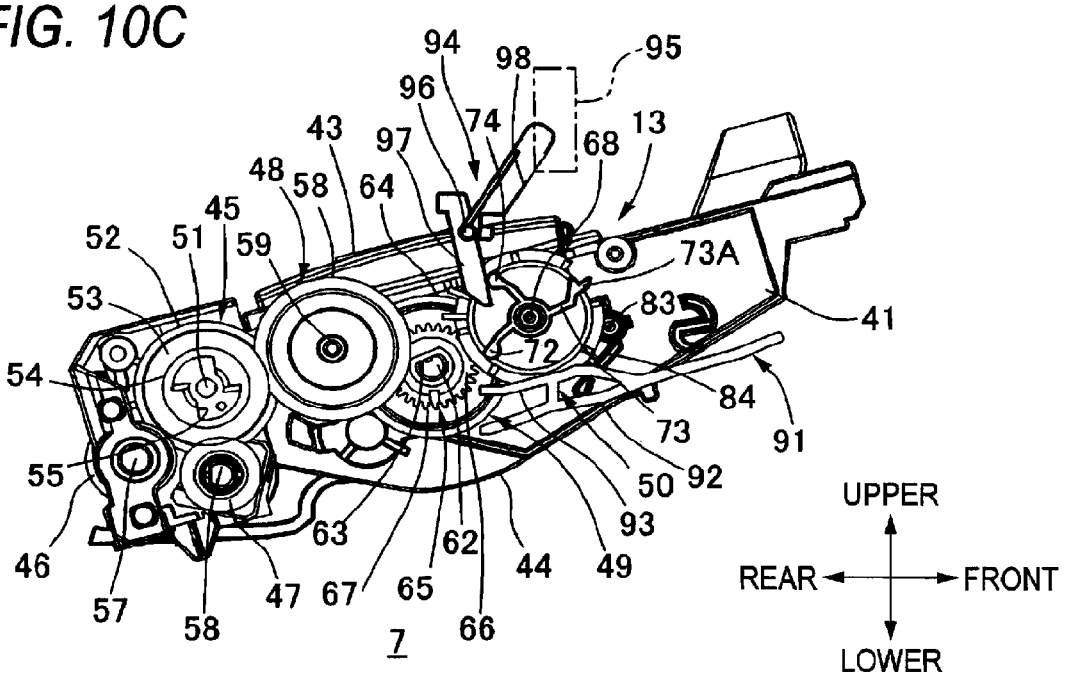
FIG. 10C is a left side view of the developing cartridge shown in FIG. 10A.
Figure 10D:
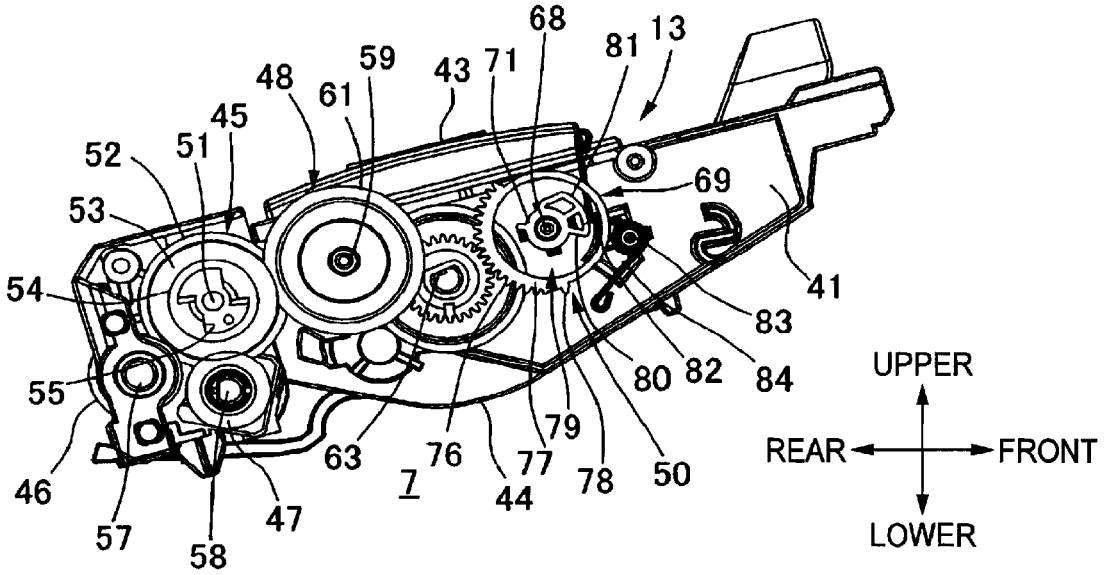
FIG. 10D is a left side of the developing cartridge shown in FIG. 10A with a part of the detectable rotary member detached.

Thereafter, when the rotation of the agitator gear 49 and the detectable rotary member 50 progresses, as shown in FIGS. 10A to 10C, a distal end portion of the third detectable portion 74 comes into abutment with the lower end portion of the abutment lever 97, whereby the lower end portion is pressed to the rear, causing the actuator 94 to change its posture again from the non-detecting posture to the detecting posture. As a result, the optical path extending from the light emitting element to the light receiving element of the light sensor 95 is interrupted by the optical path interruption lever 98, whereby an ON signal is outputted from the light sensor 95 (T6 in FIG. 12). This attains an indirect detection of the third detectable portion 74 by the light sensor 95.

Then, when the rotation of the agitator gear 49 and the detectable rotary member 50 progresses further, the distal end portion of the third detectable portion 74 moves away from the abutment lever 97 of the actuator 94, whereby the actuator 94 changes its posture again from the detecting posture to the non-detecting posture. As a result, the optical path interruption lever moves out of the optical path extending from the light emitting element to the light receiving element of the light sensor 95, whereby an OFF signal is outputted from the light sensor 95 (T7 in FIG. 12).

Figure 11A:
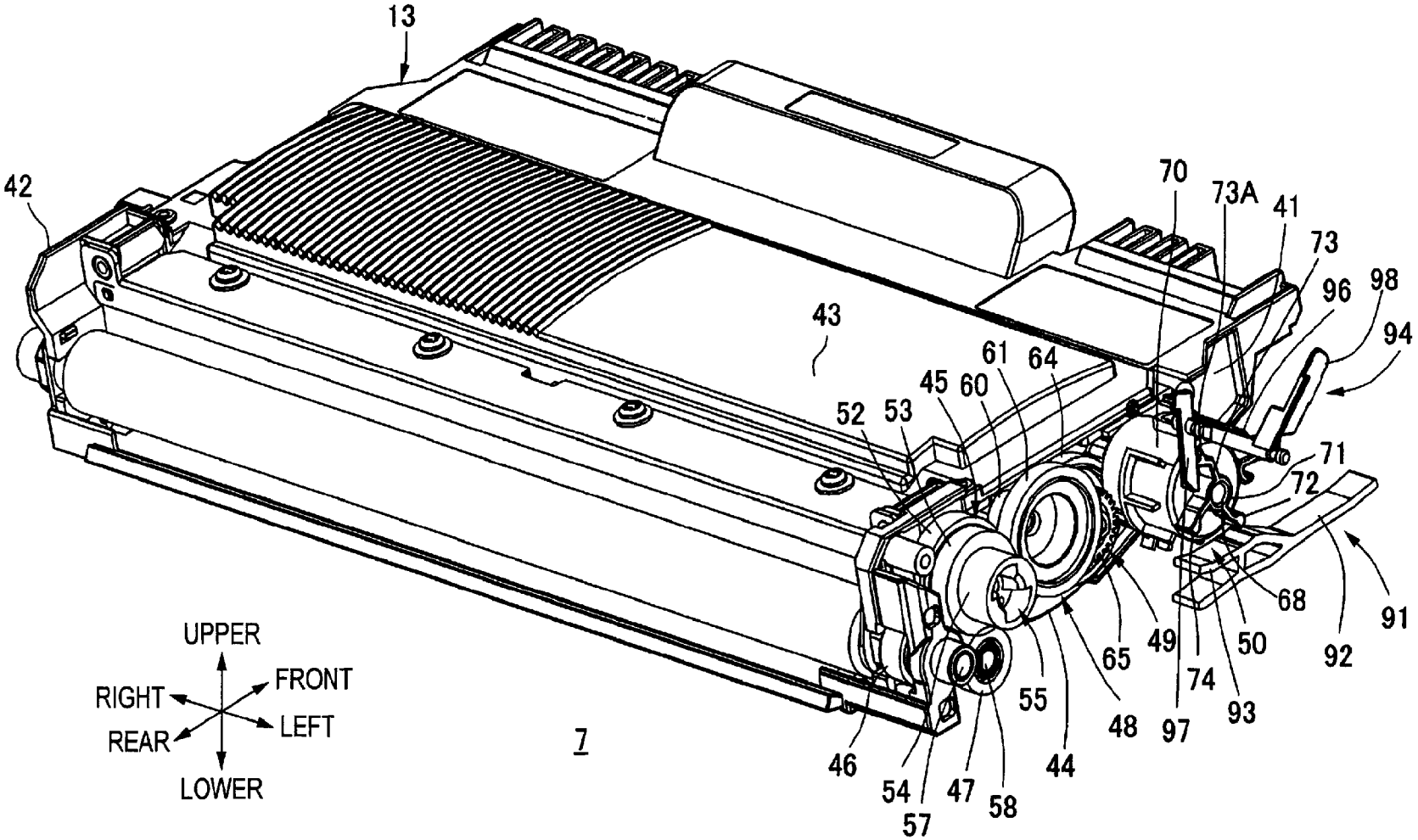
FIG. 11A is a perspective view of the developing cartridge as viewed from the left rear thereof which shows a state following the state shown in FIG. 10A.
Figure 11B:
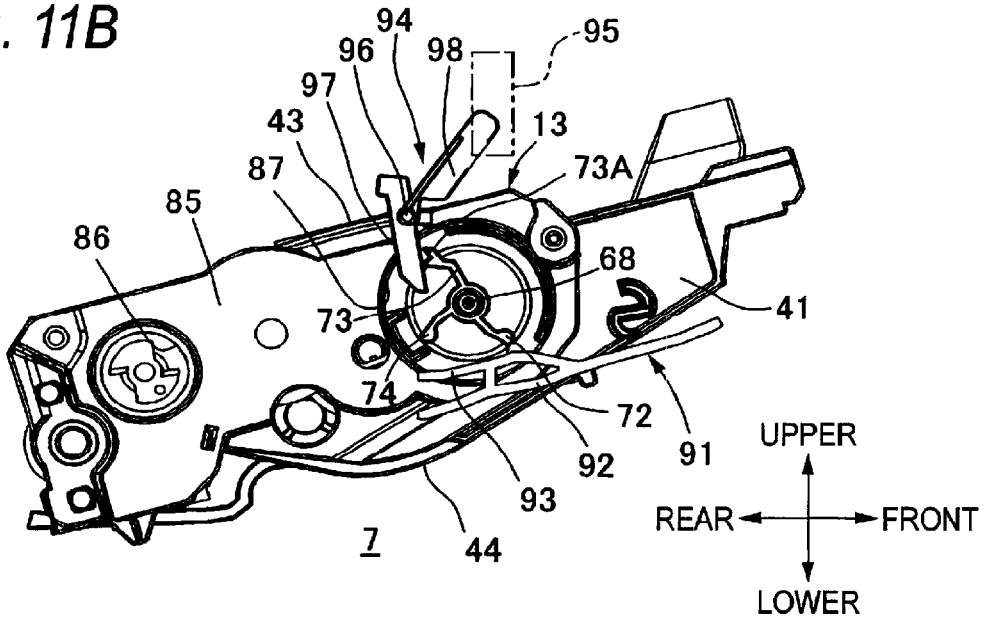
FIG. 11B is a left side view of the developing cartridge shown in FIG. 11A with the gear cover attached.
Figure 11C:
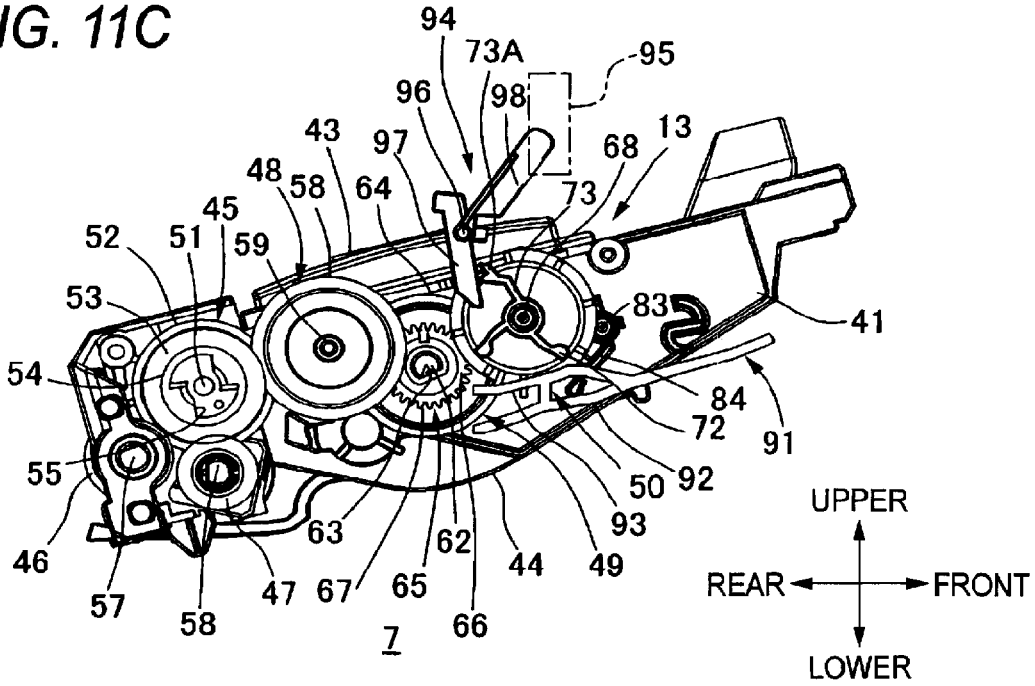
FIG. 11C is a left side view of the developing cartridge shown in FIG. 11A.

Thereafter, when the rotation of the agitator gear 49 and the detectable rotary member 50 progresses further, as shown in FIGS. 11A to 11C, the distal end portion 73A of the second detectable portion 73 comes into abutment with the lower end portion of the abutment lever 97, whereby the lower end portion is pressed to the rear, causing the actuator 94 to change its posture again from the non-detecting posture to the detecting posture. As a result, the optical path extending from the light emitting element to the light receiving element of the light sensor 95 is interrupted by the optical path interruption lever 98, whereby an ON signal is outputted from the light sensor 95 (T8 in FIG. 12). This attains an indirect detection of the second detectable portion 73 by the light sensor 95.

The rotational position of the detectable rotary member 50 corresponds to an example of a second rotational position where the second detectable portion 73 is detected by the light sensor 95.

Figure 11D:
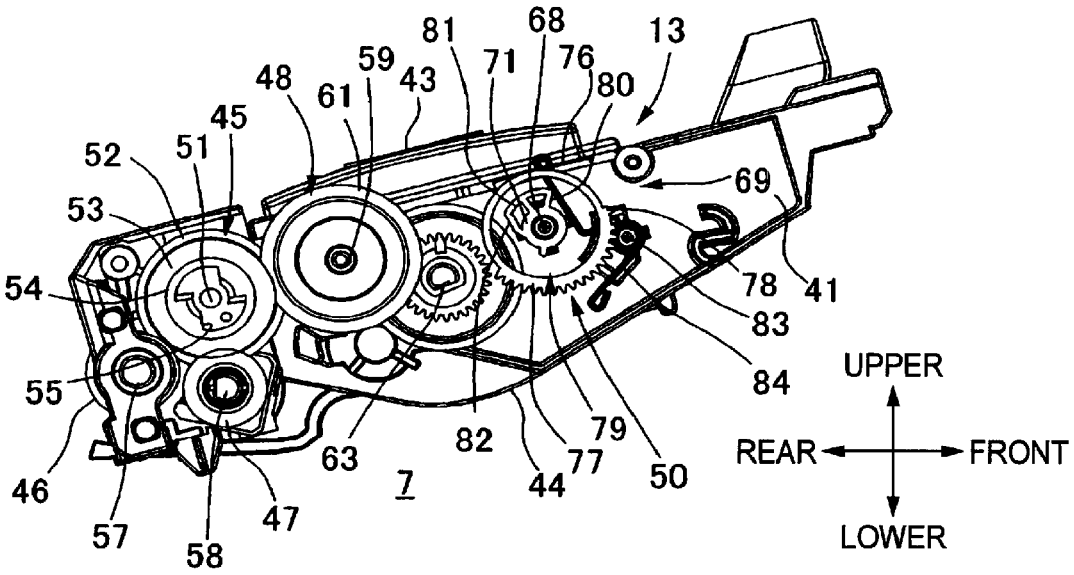
FIG. 11D is a left side of the developing cartridge shown in FIG. 11A with a part of the detectable rotary member detached.
Figure 12:
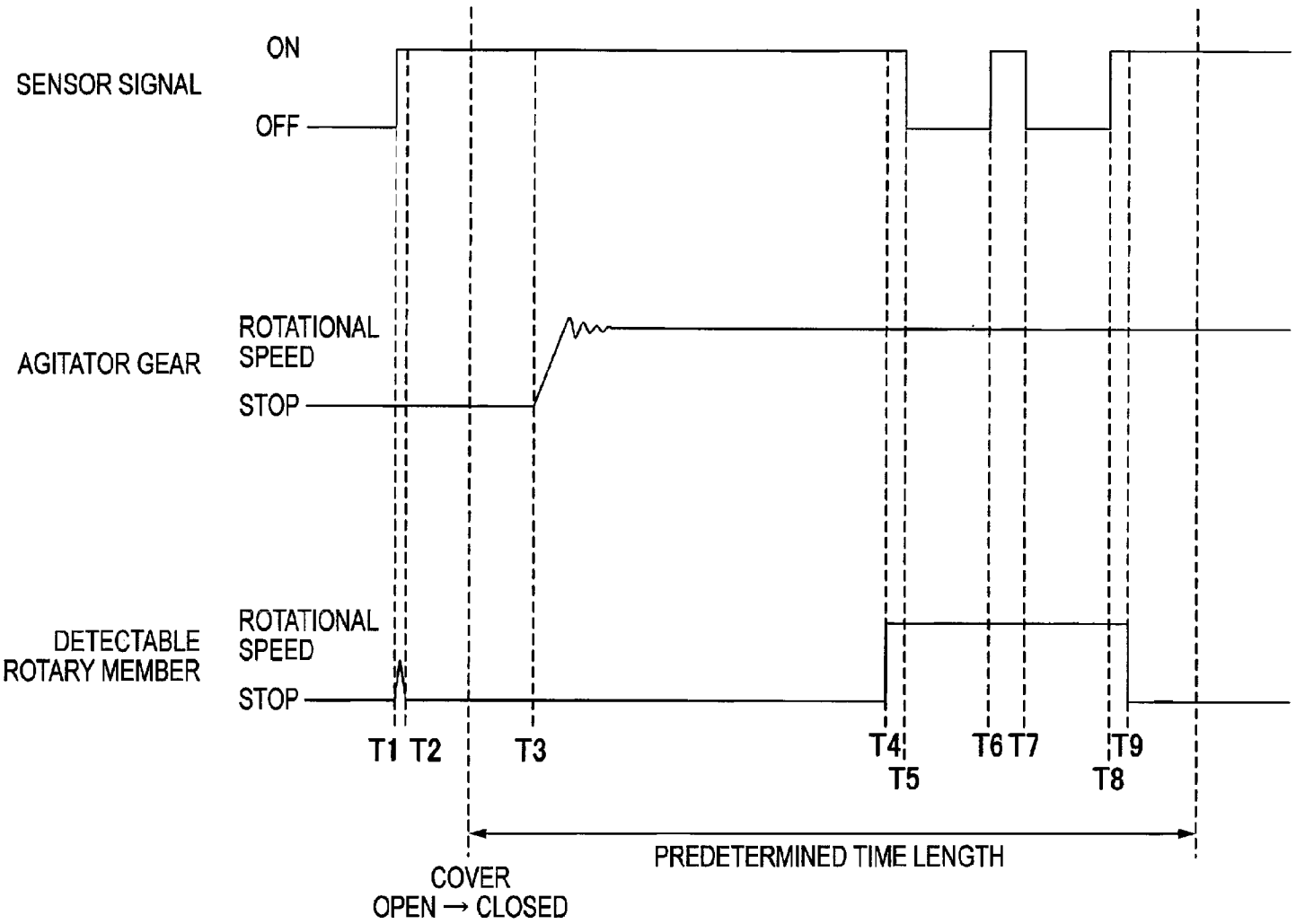
FIG. 12 is a timing chart showing operation timings of a main part when mounting of the developing cartridge is detected and the developing cartridge mounted is detected as new.

Then, as shown in FIG. 11D, when the rotation of the agitator gear 49 and the detectable rotary member 50 progresses further and the meshing engagement of the gear teeth 76 of the detectable rotary member 50 with the gear teeth 67 of the agitator gear 49 is released, the detectable rotary member stop rotating (T9 in FIG. 12). Thereafter, by the pressed portion 79 of the detectable rotary member 50 being pressed to the rear by the wire spring 84, the rotational position of the detectable rotary member 50 is held in the rotational position thereof when the meshing engagement of the gear teeth 76 of the detectable rotary member 50 with the gear teeth 67 of the agitator gear 49 is released, whereby the detectable rotary member 50 does not rotate in any way.

When a predetermined length of time elapses after the front cover 4 is closed, the warming-up operation ends, and the motor (not shown) stops rotating the driving force output member 56, whereby the input of the driving force from the driving force output member 56 into the input gear 45 is stopped.

In this way, when the new developing cartridge 7 is mounted into the body casing 2 for the first time, there occurs twice the situation in which the OFF signal is outputted from the light sensor 95. Consequently, when there occurs twice the situation in which the OFF signal is outputted from the light sensor 95 after the developing cartridge 7 is mounted into the body casing 2, it can be determined that the developing cartridge 7 mounted is new.

Further, if the developing cartridge 7 is new, when the developing cartridge 7 is mounted into the body casing 2, the distal end portion of the first detectable portion 72 presses the lower end portion of the abutment lever 97 of the actuator 94 to the rear, whereby the actuator 94 takes the detecting posture, and the ON signal is outputted from the light sensor 95. In addition, even if the developing cartridge 7 is not new or used, when the developing cartridge 7 is mounted into the body casing 2, the distal end portion 73A of the second detectable portion 73 presses the lower end portion of the abutment lever 97 of the actuator 94 to the rear, whereby the actuator 94 takes the detecting posture, and the ON signal is outputted from the light sensor 95. Consequently, irrespective of the developing cartridge 7 being new or used, the ON signal is outputted from the light sensor 95 in such a state that the developing cartridge 7 is mounted in the body casing 2. Therefore, whether or not the developing cartridge 7 is mounted in the body casing 2 can be determined based on whether or not the ON signal is outputted from the light sensor 95.

Figure 13:
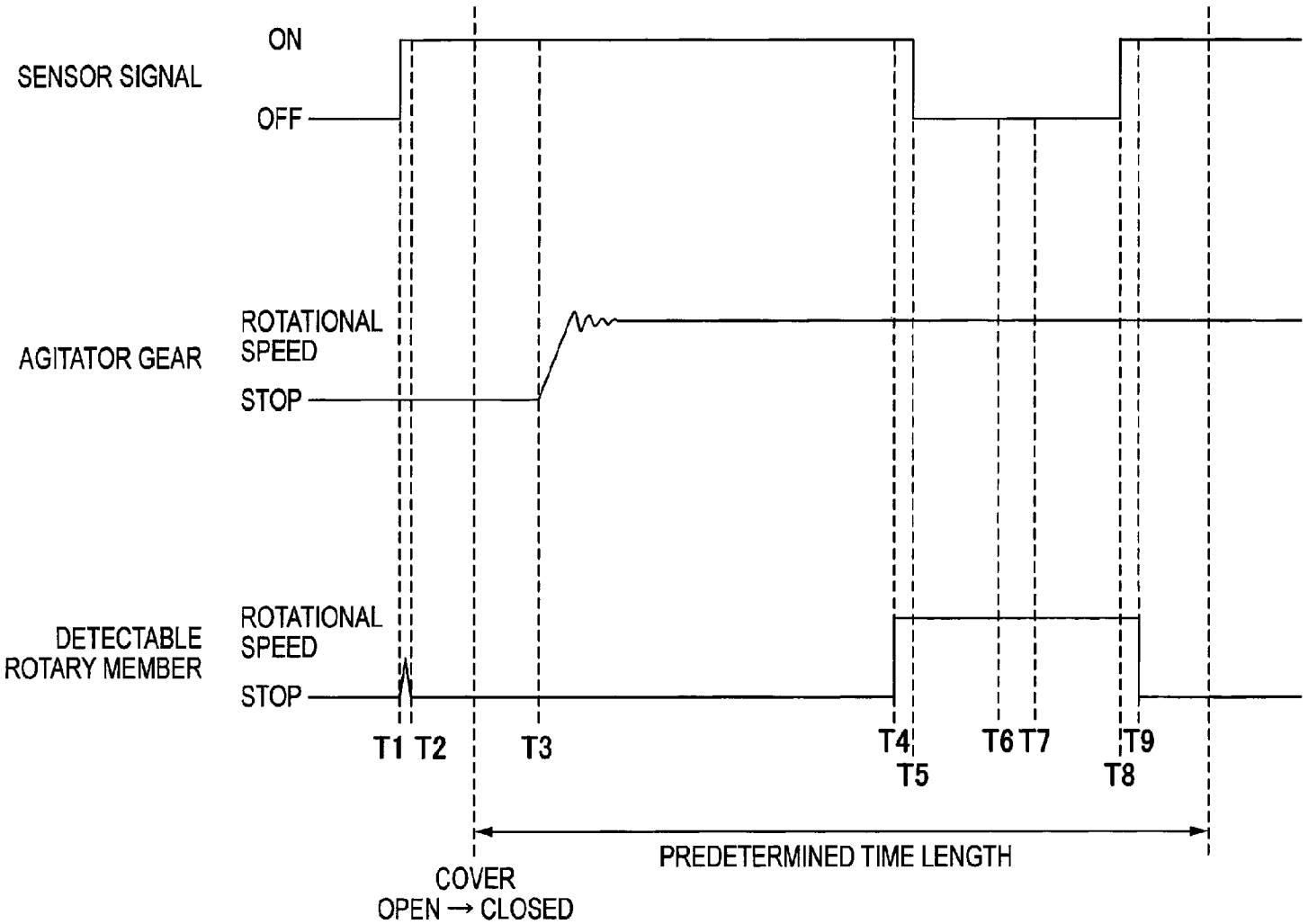
FIG. 13 is a timing chart showing other operation timings (operation timings with a third detection portion omitted) of the main part when mounting of the developing cartridge is detected and the developing cartridge mounted is detected as new.

It is noted that the third detectable portion 74 may be omitted. If the third detectable portion 74 is omitted, when the developing cartridge 7 is mounted into the body casing 2, as shown in FIG. 13, no ON signal is outputted from the light sensor 95 during a time T6 to T7, and there occurs only once the situation in which the OFF signal is outputted from the light sensor 95. Consequently, it can be determined from the fact that the situation occurs once in which the OFF signal is outputted from the light sensor 95 that the developing cartridge 7 mounted is new.

For example, the developing cartridge 7 on which the third detectable portion 74 is provided accommodates a relatively large amount of toner in the housing 13 thereof, while the developing cartridge 7 from which the third detectable portion 74 is omitted accommodates a relatively small amount of toner in the housing 13 thereof. When these developing cartridges 7 are mounted into the body casing 2 selectively, the type of the developing cartridge 7 mounted can be determined by the number of times of occurrence of the situation in which the OFF signal is outputted from the light sensor 95 after the new developing cartridge 7 is mounted in the body casing 2.

These determinations of whether or not the developing cartridge 7 is mounted in the body casing 2 and whether the developing cartridge 7 mounted is new or used are executed by a control unit (not shown) that a microcomputer has. Specifically, the control unit executes, for example, operations shown in a flowchart in FIG. 18 to determine whether or not the developing cartridge 7 is mounted in the body casing 2 and whether the developing cartridge 7 mounted is new or used.

Figure 18:
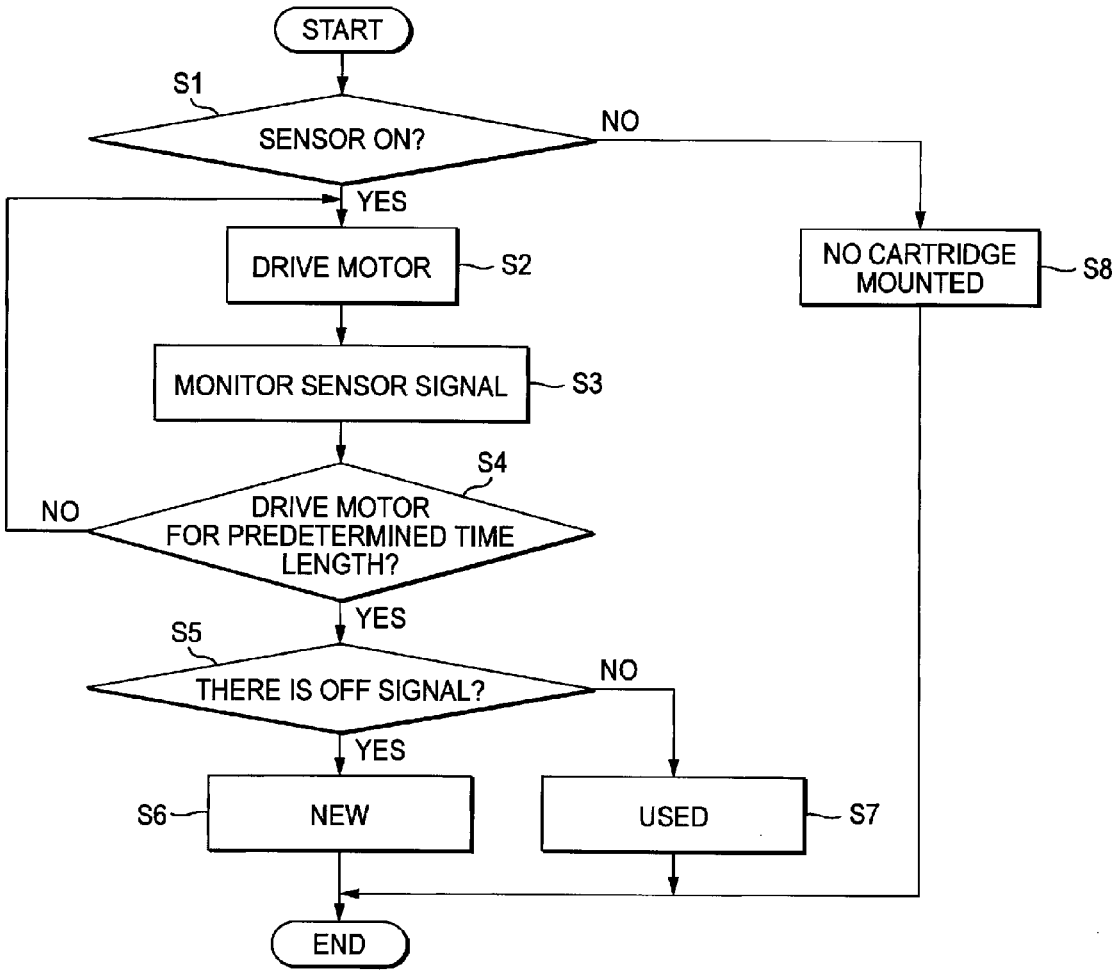
FIG. 18 is an example of a flowchart for detecting mounting of the developing cartridge and detecting whether or not the developing cartridge mounted is new (an example in which whether or not the developing cartridge is mounted is determined before the driving of a motor)

The flowchart shown in FIG. 18 is executed in response to the closure of the front cover 4.

When the front cover 4 is closed, firstly, it is checked whether or not the output signal from the light sensor 95 is the ON signal (ON) (S1).

If the output signal from the light sensor 95 is the ON signal (S1: YES), the warming-up operation is started, and the driving of the motor is started to rotate the driving force output member 56 in such a state that the driving force output member 56 is coupled to the coupling recess portion 55 of the input gear 45 (S2).

While the motor is being driven, the state of the output signal from the light sensor 95 is monitored at all times (S3). Namely, output signals from the light sensor 95 are sampled at a predetermined cycle by the control unit, and whether the output signal from the light sensor 95 is the ON signal or the OFF signal is checked repeatedly. When the output signal from the light sensor 95 is switched from the ON signal to the OFF signal, every time the switching occurs, the value of a counter within the control unit is increased (by one). The value of the counter is reset to zero when this operation starts.

When a predetermined length of time elapses from the start of driving of the motor (S4: YES), the driving of the motor is stopped, and the warming-up operation ends.

Then, it is checked whether or not the OFF signal is outputted from the light sensor 95 during the period of time when the motor is driven (the monitoring period) (S5). Specifically, it is checked whether the value of the counter is 1 or 2, or zero.

If the value of the counter is 1 or 2, it is determined that the developing cartridge 7 mounted is new (S6). In an example which is in greater detail, if the value of the counter is 1, it is determined that the developing cartridge 7 mounted is new and accommodates the relatively small amount of toner, while if the value of the counter is 2, it is determined that the developing cartridge 7 mounted is new and accommodates the relatively large amount of toner.

On the other hand, if the value of the counter is zero, it is determined that the developing cartridge 7 mounted is used (S7).

In addition, if the output signal from the light sensor 95 immediately after the front cover 4 is closed is the OFF signal (S1: NO), it is determined that no developing cartridge 7 is mounted in the body casing 2 (S8).

6. FUNCTIONS AND ADVANTAGES

(1) Function and Advantage 1

As described above, the input gear 45, the agitator gear 49 and the detectable rotary member 50 are provided on the outer side of the first side wall 41 of the housing 13 to be rotatable about the respective axes of the input gear rotation shaft 51, the agitator rotation shaft 62 and the rotation shaft 68 which extend in parallel to each other. The axes of the input gear rotation shaft 51, the agitator rotation shaft 62 and the rotation shaft 68 are examples of a first axis, a third axis and a fourth axis. In addition, the developing roller 18 is provided between the first side wall 41 and the second side wall 42 to be rotatable about the developing rotation axis 20.

The driving force output member 56 provided in the body casing 2 is coupled to the input gear 45, and the driving force is inputted thereto from the driving force output member 56. The developing roller 18 and the agitator gear 49 rotate by the driving force inputted into the input gear 45 (the driving force that the input gear 45 receives from the driving force output member 56), whereby the engagement portion 66 provided on the agitator gear 49 rotates about the axis of the agitator rotation shaft 62 (an example of a fifth axis which is on the same axis as the third axis).

The detectable rotary member 50 has the gear teeth 76 and the engagement portion 78. The gear teeth 76 mesh with the gear teeth 67 of the agitator gear 49 when the rotational position of the detectable rotary member 50 is in a driven position, that is, when the rotational position of the detectable rotary member 50 stays within a range which ranges from the rotational position of the detectable rotary member 50 shown in FIG. 8D to the rotational position of the detectable rotary member 50 shown in FIG. 11D. The engagement portion 78 is provided on the rotating locus of the engagement portion 66 when the rotational position of the detectable rotary member 50 is in a non-driven position which is the other rotational positions than the driven position, that is, when the rotational position of the detectable rotary member 50 is in the rotational positions shown in FIGS. 3D, 4D, 5D, 6D, 7D.

Therefore, when the agitator gear 49 and the engagement portion 66 rotates by the driving force that the input gear 45 receives when the rotational position of the detectable rotary member 50 is in the non-driven position, the engagement portion 66 is brought into engagement with the engagement portion 78 which is provided on the rotating locus thereof. At this time, since the gear teeth 76 do not mesh with the gear teeth 67 of the agitator gear 49, the detectable rotary member 50 does not change the rotational position thereof to stay still until the engagement portion 66 is brought into engagement with the engagement portion 78. After the engagement of the engagement portion 66 with the engagement portion 78, by the engagement portion 66 rotating further, the force is exerted on the engagement portion 78 from the engagement portion 66, whereby the detectable rotary member 50 starts rotating. Then, when the rotational position of the detectable rotary member 50 comes in the driven position, the gear teeth 76 mesh with the agitator gear 49, whereafter the detectable rotary member 50 rotates by the driving force transmitted from the agitator gear 49.

In the laser printer 1, the developing cartridge 7 is mounted in the body casing 2, and the warming-up operation is performed in response to the mounting of the developing cartridge 7. In this warming-up operation, the detectable rotary member 50 does not rotate right after the start of driving of the driving force output member 56 (right after the start of inputting of the driving force into the input gear 45), and the detectable rotary member 50 starts rotating after the passage of the time required from the start of driving of the driving force output member 56 to the engagement of the engagement portion 66 with the engagement portion 78. By this configuration, the detectable rotary member 50 is allowed to rotate stably after the driving force that is inputted into the input gear 45 from the driving force output member 56 has become stable. The first detectable portion 72, the second detectable portion 73 and the third detectable portion 74 move in association with the rotation of the detectable rotary member 50. Consequently, the first detectable portion 72, the second detectable portion 73 and the third detectable portion 74 are allowed to move at stable speeds.

Consequently, the developing cartridge 7 is superior to the conventional developing cartridge.

(2) Function and Advantage 2

The developing cartridge 7 includes the agitator 16. The agitator 16 rotates about the axis of the agitator rotation shaft 62 (an example of a sixth axis which is on the same axis as the third axis). Toner accommodated in the housing 13 can be agitated by the rotating agitator 16.

With a new developing cartridge 7, there may be a situation in which toner in the housing 13 solidifies. In this case, a large load (resistance) is exerted on the agitator 16 which rotates integrally with the agitator gear 49 immediately after the new developing cartridge 7 is mounted in the body casing 2 and the agitator gear 49 starts rotating by the driving force that the input gear 45 receives from the driving force output member 56. Then, when the toner is started to be loosened, the load exerted on the agitator 16 is reduced, and the magnitude of the load is stabilized at a constant level. That is, the rotation of the agitator gear 40 becomes unstable from the start of rotation of the agitator gear 49 until the loosening of the solidified toner.

The detectable rotary member 50 does not follow the rotation of the agitator gear 49 immediately after the driving force output member 56 is started to be driven (immediately after the driving force is started to be inputted into the input gear 45). The detectable rotary member 50 starts to follow the rotation of the agitator gear 49 after the passage of the time required from the start of driving of the driving force output member 56 until the engagement of the engagement portion 66 with the engagement portion 78. Consequently, the detectable rotary member 50 is allowed to follow the rotation of the agitator gear 49 after the toner solidified in the housing 13 is loosened. As a result, the rotation of the detectable rotary member 50 can be stabilized further, thereby making it possible to allow the first detectable portion 72 and the second detectable portion 73 to move at the stable speed.

(3) Function and Advantage 3

The detectable rotary member 50 has the first detectable portion 72 and the second detectable portion 73. Then, the detectable rotary member 50 rotates, by following the rotation of the agitator gear 49, from the first rotational position where the distal end portion of the first detectable portion 72 is brought into abutment with the lower end portion of the abutment lever 97 to the second rotational position where the distal end portion of the second detectable portion 73 is brought into abutment with the lower end portion of the abutment lever 97. By this configuration, when the detectable rotary member 50 rotates after the developing cartridge 7 is mounted in the body casing 2, since both the first detectable portion 72 and the second detectable portion 73 are detected by the light sensor 95, information that the developing cartridge 7 mounted is new can be obtained based on the detection of those detectable portions.

(4) Function and Advantage 4

When the rotational position of the detectable rotary member 50 is in the second rotational position, the gear teeth 76 do not mesh with the agitator 49, and the detectable rotary member 50 is made free relative to the agitator gear 49.

(5) Function and Advantage (5)

The developing cartridge 7 includes the wire spring 84. According to this configuration, even though the second detectable portion 73 is brought into abutment with the abutment lever 97 of the actuator 94 to thereby exert the pressing force of the spring (not shown) provided on the actuator 94 on the second detectable portion 73, the state is held in a state where the detectable rotary member 50 stays in the second rotational position by the pressed portion 79 of the detectable rotary member 50 being pressed by the wire spring 84. Therefore, the second detectable portion 73 continues to be detected by the light sensor 95 while the developing cartridge 7 is mounted in the body casing 2. Consequently, whether or not the developing cartridge 7 is mounted in the body casing 2 can be determined well based on whether or not the second detectable portion 73 is detected by the light sensor 95.

(6) Function and Advantage 6

The interference member 91 is fixed in the body casing 2. Then, in the process of mounting the developing cartridge 7 into the body casing 2, the interference member 91 contacts the second detectable portion 73, whereby the detectable rotary member 50 rotates from the third rotational position where the engagement portion 78 is provided out of the rotating locus drawn by the engagement portion 66 when the agitator gear 49 rotates to the first rotational position.

(7) Function and Advantage 7

In such a state where the detectable rotary member 50 stays in the third rotational position, the engagement portion 78 is provided out of the rotating locus of the engagement portion 66. When the detectable rotary member 50 rotates from the third rotational position to the first rotational position, the engagement portion 78 is provided on the rotating locus of the engagement portion 66. Consequently, when the engagement portion 6 moves thereafter, the engagement portion 66 is allowed to be surely brought into engagement with the engagement portion 78.

(8) Function and Advantage 8

The first detectable portion 72 and the second detectable portion 73 extend in the radius direction of the rotation of the detectable rotary member 50. The second detectable portion 73 projects outside the rotating locus drawn by the first detectable portion 72 when the detectable rotary member 50 rotates, and the projecting portion or the radially extending portion 82 constitutes an abutment portion with which the interference member 91 is brought into abutment when the developing cartridge 7 is mounted into the body casing 2. By this configuration, while the interference member 91 is allowed to be surely brought into abutment with the second detectable portion 73, the first detectable portion 72 can be prevented from being brought into abutment with the interference member 91 when the detectable rotary member 50 rotates.

(9) Function and Advantage 9

In addition, since the first detectable portion 72 and the second detectable portion 73 are provided away from each other in the rotating direction of the detectable rotary member 50, even though the detectable rotary member 50 does not rotate through 360.degree., the rotational position of the detectable rotary member 50 is changed to the first rotational position where the first detectable portion 72 is detected by the light sensor 95 to the second rotational position where the second detectable portion 73 is detected by the light sensor 95. Therefore, due to the detectable rotary member 50 including the first detectable portion 72 and the second detectable portion 73, the detection of the first detectable portion 72 and the second detectable portion 73 by the light sensor 95 can be performed without rotating the detectable rotary member 50 through 360.degree., while due to the detectable rotary member 50 including the partly non-tooth gear portion 69, the transmission of the driving force from the agitator gear 49 to the detectable rotary member 50 can be cut off.

For example, it might be considered that both the determination of whether or not the developing cartridge 7 mounted is new and the determination of whether or not the developing cartridge 7 is mounted in the body casing 2 can be implemented by detecting only the first detectable portion 72 by the light sensor 95 with the second detectable portion 73 omitted.

In this case, it is necessary that the first detectable portion 72 comes into abutment with the abutment lever 97 of the actuator 94 so that the first detectable portion 72 is detected by the light sensor 95 at a time when the new developing cartridge 7 is mounted in the body casing 2. Then, it is necessary that after the first detectable portion 72 temporarily moves away from the abutment lever 97 by the rotation of the detectable rotary member 50, the detectable rotary member 50 rotates through 360.degree. after the mounting of the developing cartridge 7, causing the first detectable portion 72 to come into abutment with the abutment lever 97 again so that the first detectable portion 72 is detected by the light sensor 95. Further, the transmission of the driving force from the agitator gear 49 to the detectable rotary member 50 has to be cut off at a time when the detectable rotary member 50 rotates through 360.degree.

These three requirements cannot be satisfied by the configuration in which the partly non-tooth gear portion 69 is provided. To satisfy those requirements, a complex mechanism such as a clutch mechanism has to be provided, which makes the configuration of the developing cartridge 7 (the laser printer 1) complex and increases the manufacturing costs thereof.

By including the second detectable portion 73 separately from the first detectable portion 72 and including the partly non-tooth gear portion 69, the three requirements can be satisfied which are necessary to determine well whether or not the developing cartridge 7 mounted new or used and whether or not the developing cartridge 7 is mounted in the body casing 2.

7. MODIFIED EXAMPLES

(1) Modified Example 1

Figure 14:
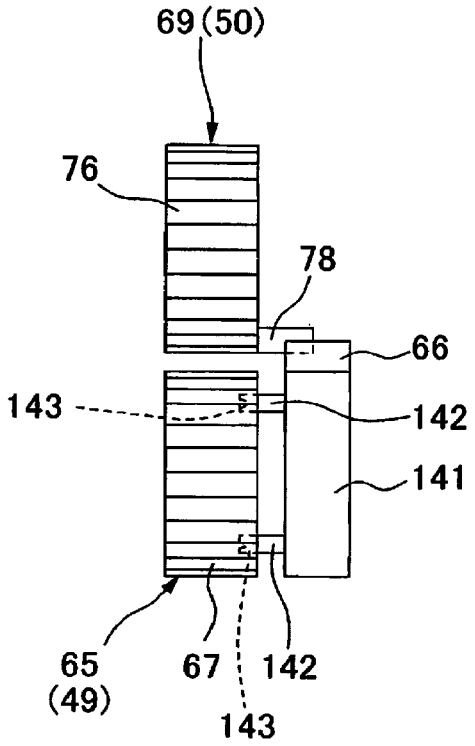
FIG. 14 is a plan view showing a configuration (Modified Example 1) in which an engagement portion is formed separately from an agitator gear.

In the laser printer 1, the engagement portion 66 is formed integrally on the small-diameter gear portion 65 of the agitator gear 49. As shown in FIG. 14, however, for example, a cylindrical connecting member 141 may be provided as a separate member from a small-diameter gear portion 65. In this case, an engagement portion 66 is formed on the connecting member 141 so as to project from a circumferential surface of the connecting member 141, and the connecting member 141 is connected to the small-diameter gear portion 65 to rotate together therewith (so as not to rotate relatively).

In this case, the small-diameter gear portion 65 and the connecting member 141 can rotate together by fitting two bosses 142 provided on the connecting member 141 so as to extend towards the small-diameter gear portion 65 in recess portions 143 provided in the small-diameter gear portion 65.

(2) Modified Example 2

Figure 15:
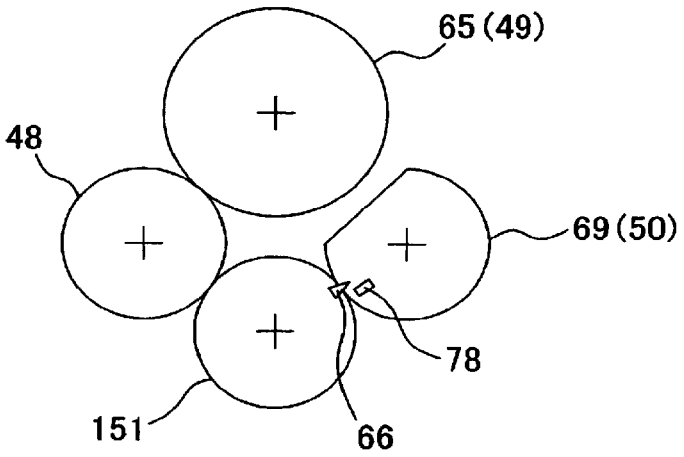
FIG. 15 is an illustrative side view showing a configuration (Modified Example 2) in which an engagement portion is formed on a gear different from an agitator gear.

In addition, as shown in FIG. 15, an engagement portion 66 may be formed on a different gear 151 to which a driving force is transmitted from an intermediate gear 48 so as to project from a circumferential surface of the gear 151 at a distal end thereof, so that an engagement portion 78 is pressed by the gear 151 when it rotates. In this case, a detectable rotary member 50 rotates to a position where a partly non-tooth gear portion 69 receives a drive force from a small-diameter gear portion 65 of an agitator gear 49 by firstly the engagement portion 78 being brought into contact with the engagement portion 66 provided on the gear 151.

(3) Modified Example 3

Figure 16:
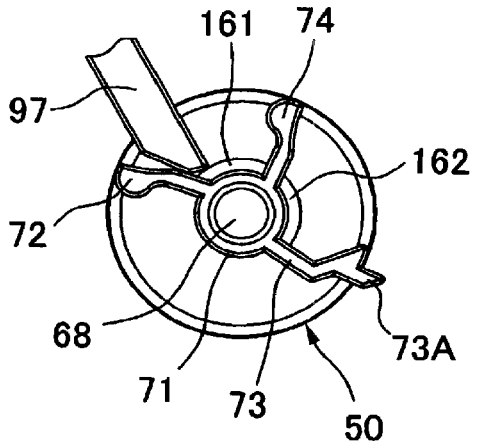
FIG. 16 is a side view showing a configuration (Modified Example 3) in which a first detectable portion and a second detectable portion are integrated.

A first detectable portion 72 and a second detectable portion 73 may be integrated together. For example, as shown in FIG. 16, connecting portions 161, 162, which extend along an outer circumferential surface of a cylindrical portion 71 and constitute an example of a non-detecting portion, are formed between the first detectable portion 72 and a third detectable portion 74 and between the third detectable portion 74 and the second detectable portion 73, respectively, so that the first detectable portion 72, the second detectable portion 73 and the third detectable portion 74 are integrated together.

In this case, a configuration may be adopted in which an abutment lever 97 of an actuator 94 is brought into abutment with connecting portions 161, 162. In this configuration, a height of the connecting portions 161, 162 (a length of a detectable rotary member 50 in the direction of turning radius) is formed smaller than lengths of the first detectable portion 72 and the second detectable portion 73 and is formed to such an extent that even though an abutment lever 97 of an actuator 94 is brought into abutment with the connecting portions 161, 162, an optical path interruption lever 98 of the actuator 94 is prevented from moving out of an optical path of the light sensor 95.

(4) Modified Example 4

Figure 17:
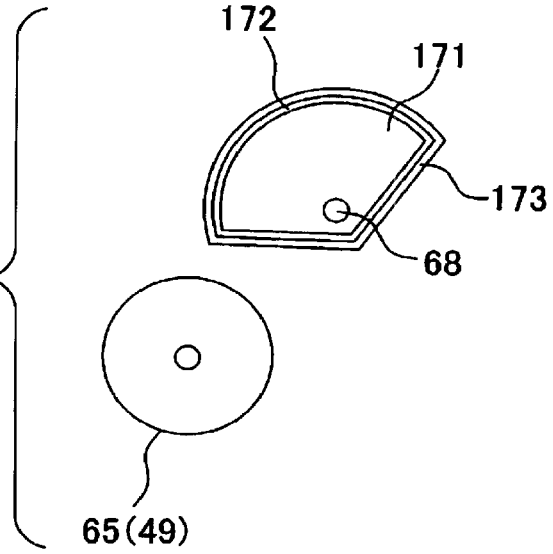
FIG. 17 is an illustrative side view showing a configuration (Modified Example 4) which employs alternative of a non-tooth portion of a detectable rotary member.

In the laser printer 1, the partly non-tooth gear portion 69 is provided on the detectable rotary member 50, and the gear teeth 76 are formed on the outermost circumferential surface of the partly non-tooth gear portion 69. However, the following configuration may be adopted in place of the cylindrical portion on an outer side of the partly non-tooth gear portion 69. For example, as shown in FIG. 17, a fan-shaped main body 171 which is centered at a rotation shaft 68 of a detectable rotary member 50 and a resistance imparting member 173 may be provided. At least an outer circumferential surface of the resistance imparting member 173 is formed of a material such as a rubber having a relatively large friction coefficient, and the resistance imparting member 173 is wound round an outer circumference of a wall portion 172 erected along a circumferential edge of the main body 171. In this case, gear teeth 67 may be formed or may not be formed on a circumferential surface of a small-diameter gear portion 65 of an agitator gear 49. The main body 171 and the resistance imparting member 173 are sized so that an angle formed by two planes of the outer circumferential surface of the resistance imparting member 173 is about 230.degree. and that those plane do not contact the small-diameter gear portion 65 but an arc surface of the outer circumferential surface of the resistance imparting member 173 contacts the circumferential surface of the small-diameter gear portion 65.

(5) Modified Example 5

Figure 19:
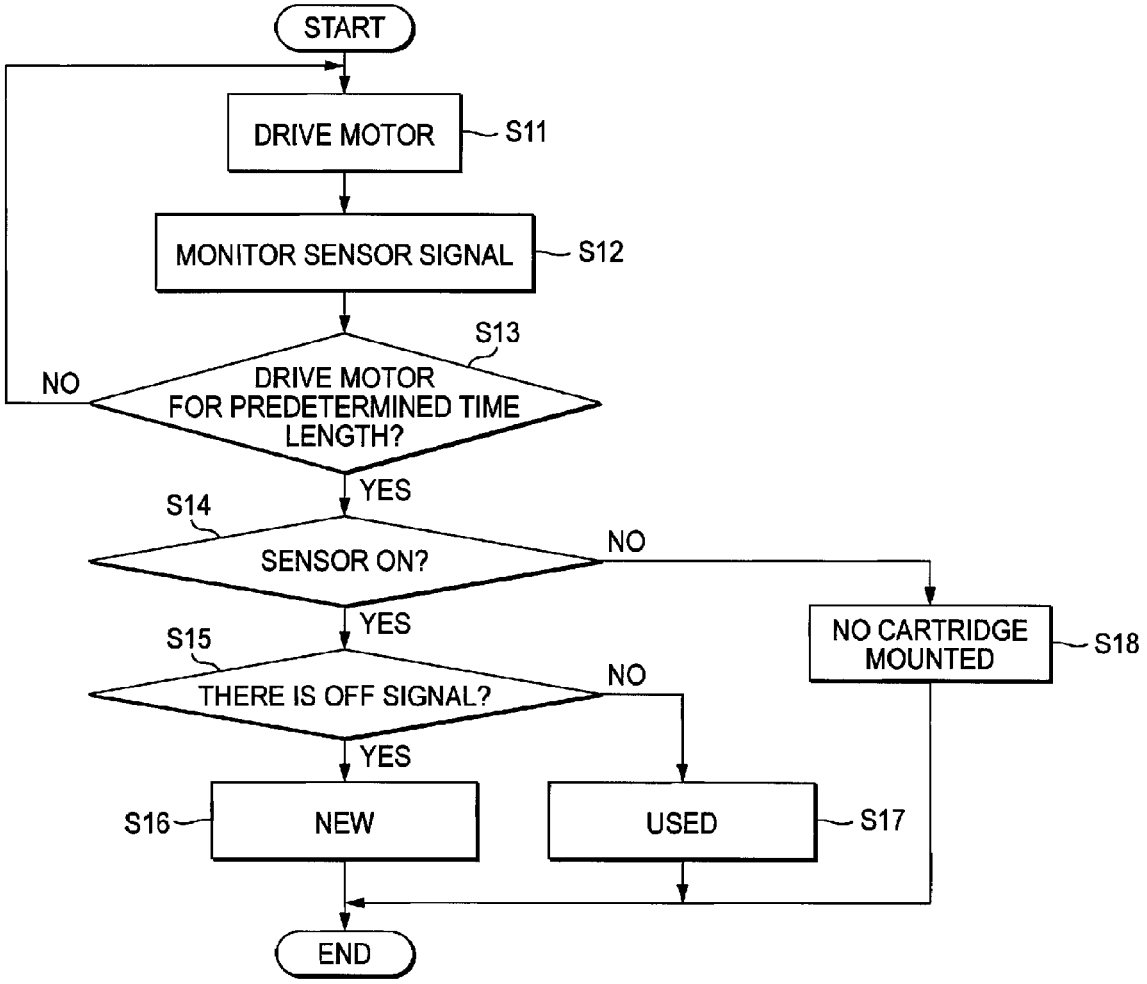
FIG. 19 is another example of a flowchart for detecting mounting of the developing cartridge and detecting whether or not the developing cartridge mounted is new (an example in which whether or not the developing cartridge is mounted is determined after the driving of a motor).

To determine whether or not the developing cartridge 7 is mounted in the body casing 2 and whether the developing cartridge 7 mounted is new or used, the control unit executes operations shown in a flowchart in FIG. 19 in place of the operations shown in the flowchart in FIG. 18.

The flowchart in FIG. 19 is executed in response to the closure of the front cover 4.

When the front cover 4 is closed, a warming-up operation is started, and the motor (not shown) is started to be driven to rotate the driving force output member 56 in such a state that the driving force output member 56 is coupled to the coupling recess portion 55 of the input gear 45 (S11).

While the motor is being driven, the state of an output signal from the light sensor 95 is monitored at all times (S12). Namely, output signals of the light sensor 95 are sampled at a predetermined cycle by the control unit so as to check repeatedly whether the output signal from the light sensor 95 is an ON signal or an OFF signal. When the output signal from the light sensor 95 is switched from the ON signal to the OFF signal, every time the output signal is so switched, the value of the counter in the control unit is increased (by one). The value of the counter is reset to zero when this operation is started.

The driving of the motor is stopped after the passage of a predetermined length of time from the start of driving of the motor (S13: YES), and the warming-up operation ends.

Thereafter, it is checked whether or not the output signal from the light sensor 95 is the ON signal (ON) (S14).

If the output signal from the light sensor 95 is the ON signal (S14: YES), it is checked whether or not the OFF signal is outputted from the light sensor 95 during a period of time when the motor is driven (a monitoring period) (S15). Specifically, it is checked whether the value of the counter in the control unit is 1 or 2.

If the value of the counter is 1 or 2, it is determined that the developing cartridge 7 mounted is new (S16). In an example which is greater detail, if the value of the counter is 1, it is determined that the developing cartridge 7 is new and accommodates a relatively small amount of toner. If the value of the counter is 2, it is determined that the developing cartridge 7 is new and accommodates a relatively large amount of toner.

On the other hand, if the value of the counter is zero, it is determined that the developing cartridge 7 is used (S17).

In addition, if the output signal from the light sensor 95 at a point in time when the warming-up operation ends is the OFF signal (S14: NO), it is determined that no developing cartridge 7 is mounted in the body casing 2 (S18).

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A developing cartridge comprising:

a housing configured to accommodate developer therein;

a first gear rotatable about a first axis extending in an extending direction from a first rotational position to a second rotational position and from the second rotational position to a third rotational position, the first gear including first gear teeth; and a detection gear rotatable about a second axis extending in the extending direction, the detection gear including:

second gear teeth; and a protrusion extending in the extending direction, the protrusion being rotatable with the detection gear, wherein the second gear teeth disengage with the first gear teeth in a case where the first gear rotates from the first rotational position to the second rotational position, wherein the second gear teeth engage with the first gear teeth in a case where the first gear rotates from the second rotational position to the third rotational position, wherein the detection gear is not rotatable with the first gear in a case where the first gear rotates from the first rotational position to the second rotational position, and wherein the detection gear is rotatable with the first gear in a case where the first gear rotates from the second rotational position to the third rotational position.

2. The developing cartridge according to claim 1, wherein the detection gear further includes:

a first engagement portion extending in a portion of a peripheral surface of the detection gear, wherein the detection gear is not rotatable with the first gear in a case where the first engagement portion disengages with the first gear, and wherein the detection gear is rotatable with the first gear in a case where the first engagement portion engages with the first gear.

3. The developing cartridge according to claim 1, further comprising an agitator rotatable about the first axis, wherein the first gear is mounted to the agitator and rotatable with the agitator.

4. The developing cartridge according to claim 1, wherein the detection gear further includes a toothless portion.

5. A developing cartridge comprising:

a housing configured to accommodate developer therein;

a first gear rotatable about a first axis extending in an extending direction from a first rotational position to a second rotational position and from the second rotational position to a third rotational position, the first gear including first gear teeth; and a detection gear rotatable about a second axis extending in the extending direction, the detection gear including:

a protrusion extending in the extending direction, the protrusion being rotatable with the detection gear; and second gear teeth, wherein the second gear teeth disengage with the first gear teeth in a case where the first gear rotates from the first rotational position to the second rotational position, and wherein the second gear teeth engage with the first gear teeth in a case where the first gear rotates from the second rotational position to the third rotational position.

* * * * *